US006670944B1

(12) United States Patent
Ishii

(10) Patent No.: US 6,670,944 B1
(45) Date of Patent: Dec. 30, 2003

(54) SHIFT REGISTER CIRCUIT, DRIVING CIRCUIT FOR AN ELECTROOPTICAL DEVICE, ELECTROOPTICAL DEVICE, AND ELECTRONIC APPARATUS

(75) Inventor: Kenya Ishii, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/449,757

(22) Filed: Nov. 26, 1999

(30) Foreign Application Priority Data

Nov. 26, 1998 (JP) ..... 10-336339

(51) Int. Cl.[7] ..... G09G 3/36
(52) U.S. Cl. ..... 345/100; 345/87
(58) Field of Search ..... 345/87, 90, 92, 345/93, 98–100; 377/64, 68, 70, 72, 73, 77; 340/825.68; 365/78, 189.11

(56) References Cited

U.S. PATENT DOCUMENTS 3,851,187 A * 11/1974 Pao et al. ..... 377/75
5,646,642 A * 7/1997 Maekawa et al. ..... 345/99
5,894,296 A * 4/1999 Maekawa ..... 345/98
5,990,857 A * 11/1999 Kubota et al. ..... 345/98
6,300,927 B1 * 10/2001 Kubota et al. ..... 345/92

FOREIGN PATENT DOCUMENTS

JP 2000-039170 * 12/2000 ..... G11C/19/28

OTHER PUBLICATIONS

Abstract and Claims Partial Translation of JP 2000–039170.*

* cited by examiner

*Primary Examiner*—Richard Hjerpe
*Assistant Examiner*—Alexander Eisen
(74) *Attorney, Agent, or Firm*—Oliff & Berridge, PLC

(57) ABSTRACT

A driving circuit for driving an electrooptical device is provided and may include a shift register circuit including a plurality of stages of unit circuits connected in a cascaded fashion for shifting a transfer start pulse from one stage to another in response to clock signals with a large logic swing, and level shifters each coupled with one or more stages of unit circuits of the shift register circuit. The level shifters serve to convert a clock signal and an inverted clock signal with a small logic swing to clock signals with the large logic swing and supply the resultant clock signals to the corresponding one or more stages of unit circuits, thereby allowing a reduction in power consumption due to the capacitance associated with lines used to supply signals with the large logic swing.

30 Claims, 17 Drawing Sheets

SHIFT REGISTER CIRCUIT, DRIVING CIRCUIT FOR AN ELECTROOPTICAL DEVICE, ELECTROOPTICAL DEVICE, AND ELECTRONIC APPARATUS

BACKGROUND OF THE INVENTION

1. Field of Invention

The present invention relates to a shift register circuit including a plurality of stages connected in a cascaded fashion, a driving circuit for driving an electrooptical device including a plurality of pixels, an electrooptical device using such a driving circuit, and an electronic apparatus employing such an electrooptical device as a display device.

2. Description of Related Art

A conventional electrooptical device, such as an active matrix liquid crystal display device, consists mainly of a device substrate on which pixel electrodes together with switching elements are formed in a matrix fashion, an opposite substrate on which a color filter is formed, and a liquid crystal disposed in a space between the two substrates. In this structure, if a scanning signal (selection voltage) is applied to a switching element via a scanning line, the switching element is brought into a conductive state. When the switching element is in the conductive state, if an image signal is applied to a pixel electrode via a data line, an arbitrary charge is stored in the liquid crystal layer between that pixel electrode and an opposite electrode (common electrode). After storing the charge, a non-selection voltage is applied to the switching element so as to turn it off. If the liquid crystal layer has a sufficiently high resistance, the charge is maintained in the liquid crystal layer even after the switching element has been turned off. The orientation of the liquid crystal can be controlled for each pixel by controlling the amount of charge stored via the respective switching elements. Thus, desired information can be displayed.

In this technique, the operation of storing the charge into the liquid crystal layer for each pixel is required only in a particular period. This allows the liquid crystal display device to be driven in a time division multiplexing fashion in which scanning lines and data lines are used in common for a plurality of pixels, as described below. That is, first, the scanning lines are sequentially selected by a scanning line driving circuit. Second, during a selection period in which one scanning line is selected, one or more data lines are selected by a data line driving circuit. Third, a sampled image signal is applied to the selected data line(s).

The scanning line driving circuit and the data line driving circuit are generally similar in construction to each other. For example, in a typical construction as shown in FIG. 19, the data line driving circuit includes a shift register circuit 1560 consisting of a plurality of unit circuits connected in a cascade fashion. A transfer start pulse DX is applied to the shift register circuit 1560 at the start of each horizontal scanning period. The transfer start pulse DX is transferred through the cascaded unit circuits from one to another in response to a clock signal CLX and an inverted clock signal $CLX_{INV}$, and sampling pulses S1–Sn to be used to sample a data signal are output one after another from the unit circuits. Similarly, in a typical scanning line driving circuit, a transfer start pulse DY is applied, instead of the transfer start pulse DX, to a shift register circuit at the start of each vertical scanning period, and instead of the clock signal CLX and the inverted clock signal $CLX_{INV}$, a clock signal CLY and an inverted clock signal $DLY_{INV}$ are supplied every horizontal period.

In the case of an active matrix liquid crystal display device including switching elements each formed of thin film transistors (TFTs) and also including a built-in driving circuit formed of TFTs for driving the switching elements, a rather high voltage of about 12 V is required as the operating voltage. As a result, a similar voltage is also required for the scanning line driving circuit and the data line driving circuit which perform logic operations in synchronization with clock signals. In contrast, a timing generator (not shown in FIG. 19) for supplying clock signals to a liquid crystal display panel is generally formed of a CMOS circuit whose output voltage is about 3 to 5 V. To handle the voltage difference, the data line driving circuit 158 includes, as shown in FIG. 19, level shifters (level conversion circuits) 1512 and 1522 as clock interfaces disposed at the input stage to convert a signal with a small logic swing of 0 to 3 V to a signal with a large logic swing of 0 to 12 V. That is, in the conventional scanning line driving circuit and data line driving circuit, the signal with the small logic swing generated by the timing generator is supplied to the unit circuits of the shift register circuit 1560 after being converted by the level shifter into a signal with the large logic swing.

In recent years, electrooptical devices, in particular active matrix liquid crystal display devices widely used in portable electronic apparatuses, are required to operate with very low power consumption. Of various circuits in the electrooptical device, the data line driving circuit 158 operates in synchronization with a highest-frequency clock signal and needs the greatest power consumption. Therefore, a key point to reduce the power consumption of the electrooptical device is to reduce the power consumption of the data line driving circuit 158.

In the conventional data line driving circuit 158 described above, the clock signal CLX and the inverted clock signal $CLX_{INV}$ level-shifted by the level shifters 1512 and 1522 are supplied to the unit circuits at the respective stages of the shift register circuit 1560. However, in this technique, the lines A and B which the clock signals with the large logic swing are supplied tend to become long. As a result, the capacitance associated with the lines A and B becomes large.

In general, electric power consumed by a capacitive load increases in proportion to the capacitance C of the capacitor, the frequency f of a signal supplied to the capacitor, and the square of the voltage V of the signal. Because the lines A and B serve to transmit the clock signals with the large logic swing along a large distance, the lines A and B have large capacitance C, and large voltages V are applied to the large capacitance C. Therefore, large electric power is consumed when the clock signals with the large logic swing are applied to the capacitance associated with the lines A and B.

SUMMARY OF THE INVENTION

In view of the above, it is one aspect of the present invention to provide a shift register circuit applicable to a data line driving circuit and capable of operating with small power consumption, a driving circuit using such a shift register circuit for driving an electrooptical device, an electrooptical device, and an electronic apparatus using the electrooptical device as a display device.

According to an aspect of the invention, there is provided a shift register circuit including a plurality of stages connected in a cascaded fashion for sequentially transferring an input signal in response to a clock signal with a large amplitude. The shift register circuit may further include a plurality of level shifting circuits each coupled with one or more stages of the shift register circuit, each level shifting circuit serving to convert a clock signal with a small amplitude to a clock signal with a large amplitude and supply the resultant clock signal to the one or more stages coupled with each level shifting circuit.

In this shift register circuit constructed in the above-described manner, each level shifting circuit coupled with one or more stages of the shift register circuit supplies a level-shifted clock signal with the large amplitude to the one or more stages coupled with that level shifting circuit. This allows a reduction in the length of lines used to supply the clock signal with the large amplitude compared with the conventional technique in which the clock signal with the large amplitude is supplied by one level shifting circuit to all stages. As a result, the capacitance associated with the lines used to supplying the clock signal with the large amplitude becomes small, and thus the power consumption due to the capacitance decreases.

On the other hand, in this technique, the length of the lines used to supply the clock signal with the small amplitude to the respective level shifting circuit becomes long. However, because the amplitude of the signal supplied via those lines is small, the power consumption due to the capacitance of these lines is much smaller than that associated with the large-amplitude lines.

In the present invention, the respective stages of the shift register circuit are preferably formed such that the input signal may be transferred in both directions. This allows the selecting direction to be changed depending on the application. More specifically, if this shift register circuit is employed in a horizontal or vertical scanning circuit of a display device, it becomes possible to display an image in a horizontally or vertically inverted fashion.

Furthermore, in the shift register circuit according to the present invention, it is desirable that one enabling circuit be provided for each level shifting circuit. Each enabling circuit enables the corresponding level shifting circuit to operate immediately before, or at the same time, as one or more stages of the shift register circuit coupled with that corresponding level shifting circuit, start of transferring the input signal. Each enabling circuit also disables the corresponding level shifting circuit to operate immediately after, or at the same time, as the one or more stages of the shift register circuit coupled with that corresponding level shifting circuit, complete the transferring of the input signal. In this construction, only the level shifting circuit which is required to operate, is enabled to operate, and the other level shifting circuit are disabled. As a result, unnecessary operations of the level shifting circuit are prevented, and thus power consumed by the level shifting circuit is minimized.

Preferably, each enabling circuit is a latch circuit which latches a first signal in response to a clock signal with a large amplitude supplied to a stage located ahead of the one or more stages of the shift register circuit coupled with each level shifting circuit, and which latches a second signal in response to a clock signal with a large amplitude supplied to a stage located behind the one or more stages of the shift register circuit coupled with that level shifting circuit, thereby enabling and disabling the level shifting circuit by the latched signals. Alternatively, each enabling circuit may be a logic circuit which determines the logical OR of the output signal of a stage located ahead of the one or more stages coupled with the level shifting circuit, the output signal of the one or more stages coupled with the level shifting circuit, and the output signal of a stage located behind the one or more stages coupled with the level shifting circuit, thereby enabling or disabling the level shifting circuit to operate in accordance with the output signal of the logic circuit.

In the case where such an enabling circuit is provided, it is desirable that the level shifting circuit include a shutting-off circuit for shutting off the power to the level circuit or shutting off the clock signal with the small amplitude applied to the level shifting circuit when the level shifting circuit is disabled by the enabling circuit, thereby preventing the level shifting circuit from consuming unnecessary power.

Furthermore, in the present invention, it is desirable that the shift register circuit and the level shifting circuit be formed on the same single substrate. Furthermore, it is desirable that the shift register circuit and the level shifting circuit be formed of thin film transistors formed on the same single substrate using the same process. By integrating various parts in the above-described manner, it becomes possible to reduce the total cost of the driving circuit and also reduce the space required to install the driving circuit. In particular, when thin film transistors are employed as the transistors forming the shift register circuit, if the level shifting circuit is also formed of thin film transistors on the same substrate using the same process, then the both circuits have similar electric characteristics, such as a logical threshold voltage, and thus both circuits can operate in a highly reliable fashion.

According to another aspect of the invention, there is provided a driving circuit for driving an electrooptical device, including a transfer circuit including a plurality of stages connected in a cascaded fashion, for sequentially transferring an input signal in response to a clock signal with a large amplitude and a plurality of level shifting circuits each coupled with one or more stages of the transfer circuit, each level shifting circuit serving to convert a clock signal with a small amplitude to a clock signal with a large amplitude and supply the resultant clock signal to the one or more stages coupled with each level shifting circuit.

According to still another aspect of the invention, there is provided a driving circuit for driving an electrooptical device including pixels disposed at locations corresponding to respective intersections between a plurality of scanning lines and a plurality of data lines. The driving circuit serves to drive the above pixels and may include a scanning line driving circuit for sequentially selecting the scanning lines, and a data line driving circuit including a transfer circuit that includes a plurality of stages connected in a cascaded fashion for transferring an input signal in response to a clock signal with a large amplitude. The data line driving circuit serves to sequentially select the data lines on a line-by-line or group-by-group basis in response to the transferring of the input signal performed by the transfer circuit. Each group includes a plurality of data lines, and a plurality of level shifting circuits. Each level shifting circuit is coupled with one or more stages of the transfer circuit and serves to convert a clock signal with a small amplitude to a clock signal with a large amplitude and supply the resultant clock signal to the one or more stages coupled with that level shifting circuit. An image signal supplying circuit supplies an image signal to one or more data lines selected by the data line driving circuit.

In the driving circuit constructed in the above-described manner, each level shifting circuit coupled with one or more stages of the transfer circuit including a plurality of stages connected in a cascaded fashion supplies a level-shifted clock signal with the large amplitude to the one or more stages coupled with that level shifting circuit. This allows a reduction in the length of lines used to supply the clock signal with the large amplitude compared with the conventional technique in which the clock signal with the large amplitude is supplied by one level shifting circuit to all stages. This results in a reduction in the capacitance associated with the large-amplitude lines, and thus power consumption due to the capacitance associated with these lines can be reduced.

On the other hand, in this construction, the length of the lines used to supply the clock signal with the small amplitude to the respective level shifting circuit becomes long. However, because the amplitude of the signal supplied via those lines is small, the power consumption due to the capacitance of these lines is much smaller than that associated with the large-amplitude lines.

In this driving circuit according to the present invention, it is desirable that the scanning line driving circuit include at least a transfer circuit including a plurality of stages connected in a cascaded fashion for sequentially transferring an input signal and sequentially selecting the respective scanning lines in response to the transferring of the input signal, and a plurality of level shifting circuits each coupled with one or more stages of the transfer circuit, each level shifting circuit serving to convert a clock signal with a small amplitude to a clock signal with a large amplitude and supply the resultant clock signal to the one or more stages coupled with that level shifting circuit. This construction allows a reduction in the power consumption of the scanning line driving circuit. That is, the reduction in power consumption is achieved not only in the data line driving circuit but also in the scanning line driving circuit.

In this driving circuit according to the present invention, it is desirable that the driving circuit further include an enabling circuit coupled with the corresponding level shifting circuit of the data line driving circuit and/or the scanning line driving circuit, for enabling the corresponding level shifting circuit to operate. The enabling circuit enables the level shifting circuit to operate immediately before or at the same time as one or more stages coupled with that level shifting circuit start transferring the input signal, and the enabling circuit disables that level shifting circuit to operate immediately after or at the same time as the one or more stages coupled with that level shifting circuit complete the transferring of the input signal.

In this construction, only the level shifting circuit which is required to operate is enabled to operate, and the other level shifting circuit are disabled. As a result, unnecessary operations of the level shifting circuit are prevented, and thus power consumed by the level shifting circuit is minimized.

According to still another aspect of the invention, there is provided an electrooptical device including pixels disposed at locations corresponding to respective intersections between a plurality of scanning lines and a plurality of data lines. The electrooptical device may further include a scanning line driving circuit for sequentially selecting the scanning lines, a data line driving circuit including a transfer circuit. The transfer circuit may include a plurality of stages connected in a cascaded fashion for transferring an input signal in response to a clock signal with a large amplitude. The data line driving circuit serves to sequentially select the data lines on a line-by-line or group-by-group basis in response to the transferring of the input signal performed by the transfer circuit, where each group includes a plurality of data lines, a plurality of level shifting circuits each coupled with one or more stages of the transfer circuit, and each level shifting circuit serving to convert a clock signal with a small amplitude to a clock signal with a large amplitude and supply the resultant clock signal to the one or more stages coupled with that level shifting circuit. An image signal supplying circuit for supplies an image signal to one or more data lines selected by the data line driving circuit.

In this driving circuit according to the present invention, it is desirable that the scanning line driving circuit include at least a transfer circuit including a plurality of stages connected in a cascaded fashion for sequentially transferring an input signal and sequentially selecting the respective scanning lines in response to the transferring of the input signal, and a plurality of level shifting circuits each coupled with one or more stages of the transfer circuit, each level shifting circuit serving to convert a clock signal with a small amplitude to a clock signal with a large amplitude and supply the resultant clock signal to the one or more stages coupled with that level shifting circuit.

In this driving circuit according to the present invention, it is desirable that the driving circuit further include an enabling circuit coupled with the corresponding level shifting circuit of the data line driving circuit and/or the scanning line driving circuit, for enabling the corresponding level shifting circuit to operate. The enabling circuit enables the level shifting circuit to operate immediately before or at the same time as one or more stages coupled with that level shifting circuit start transferring the input signal. The enabling circuit disables that level shifting circuit to operate immediately after or at the same time as the one or more stages coupled with that level shifting circuit complete the transferring of the input signal.

The electrooptical device according to the present invention has features and advantages similar to those obtained in the driving circuit described above, the electrooptical device may include a liquid crystal disposed between two substrates, and transistors corresponding to respective pixels. The transistors serve to apply the image signal supplied to the data lines to the corresponding pixels, the transistors and are formed on one of the two substrates. It is desirable that the transfer circuit and the level shifting circuit of the data line driving circuit and/or of the scanning line driving circuit be formed of thin film transistors formed on the one of the two substrates using the same process. By integrating various parts in the above-described manner, it becomes possible to reduce the total cost of the driving circuit and also reduce the space required to install the driving circuit. In particular, when thin film transistors are employed as the transistors forming the shift register circuit, if the level shifting circuit is also formed of thin film transistors on the same substrate using the same process, then the both circuits have similar electric characteristics, such as a logical threshold voltage, and thus both circuits can operate in a highly reliable fashion.

Furthermore, if the transistors of the respective pixels are also formed using the same process, then all circuits formed on the same substrate become capable of operating in a more reliable and stable fashion.

According to still another aspect of the invention, there is provided an electronic apparatus using the above-described electrooptical device as displaying circuit.

DETAILED DESCRIPTION OF PREFERRED EMBODIMENTS

The present invention is described in further detail below with reference to preferred embodiments in conjunction with the accompanying drawings.

Construction of Electrooptical Device

Figure 1:
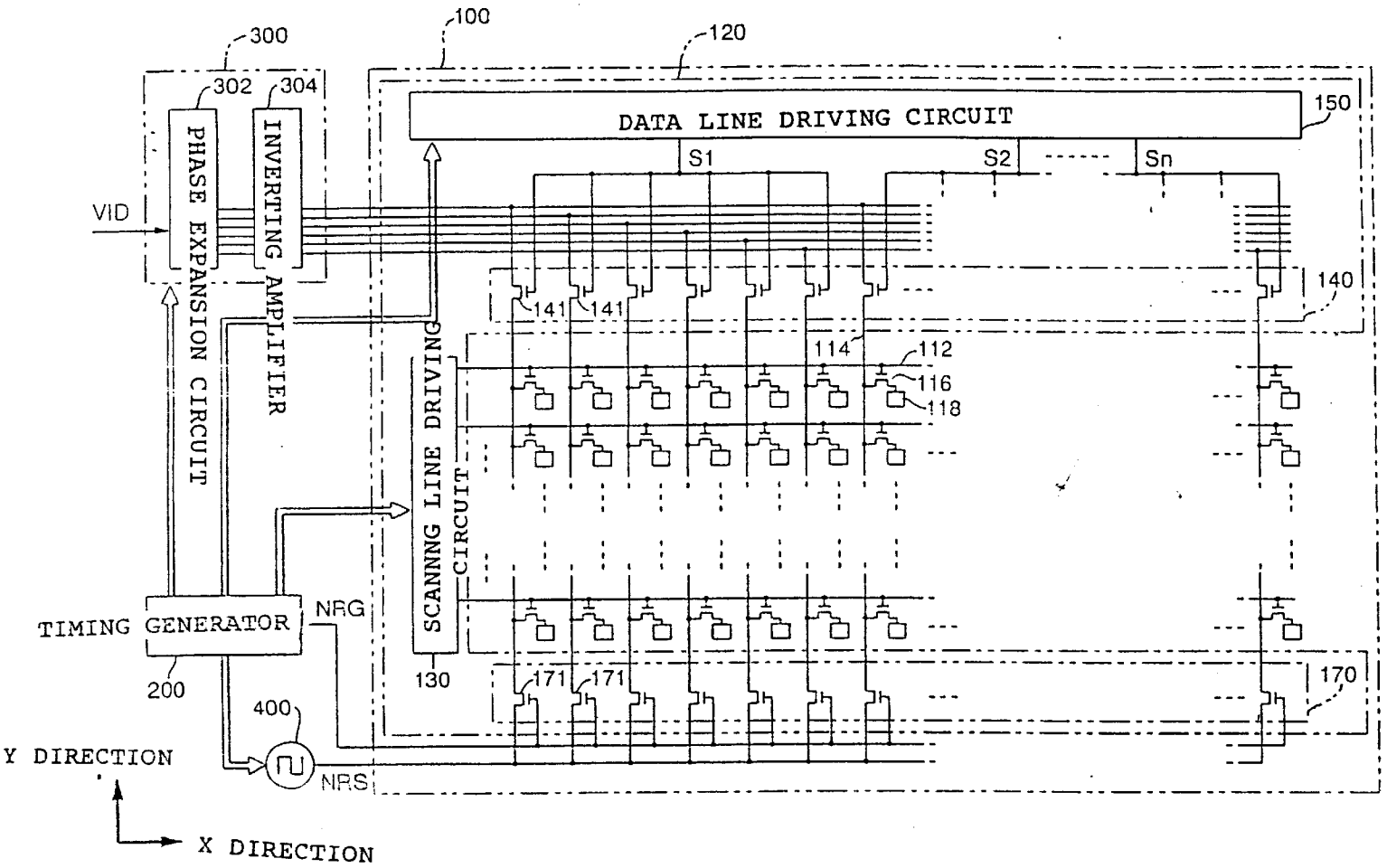
FIG. 1 is a block diagram illustrating the general construction of a liquid crystal display device including a driving circuit according to a first embodiment of the present invention.

First, as an example of an electrooptical device to which a driving circuit of a first embodiment is to be applied, a liquid crystal display device is described below. FIG. 1 is a block diagram illustrating the electric construction of the liquid crystal display device. As shown in FIG. 1, the liquid crystal display device includes a liquid crystal panel 100, a timing generator 200, an image signal processing circuit 300, and a precharge signal supply circuit 400. Of these elements, the timing generator 200 serves to output timing signals (which will be described later) used by various parts of the device. The image signal processing circuit 300 includes a phase expansion circuit 302. When the phase expansion circuit 302 receives an image signal VID, the phase expansion circuit 302 expands it into N-phases of image signals (N=6, in the specific example shown in FIG. 1) and outputs them in parallel. That is, the phase expansion circuit 302 serves as a serial-parallel converter which converts an image signal into N parallel signals. Herein, the purpose of the expansion of the image signal into N-phase signals is to allow a sampling circuit, which will be described later, to sample and hold the image signals for a longer period of time thereby allowing the image signals to be applied to the sources of the respective TFTs serving as switching elements for a longer period of time.

Of the phase-expanded image signals, signals which are required to be inverted are inverted via an inverting amplifier 304. After that, the N-phase image signals are amplified as required and supplied in parallel as image signals VID1–VID6 to the liquid crystal display panel 100. Whether or not the N-phase image signals are inverted is generally determined in accordance with whether data signals are inverted in polarity (1) in units of scanning lines; (2) in units of data signal line; or (3) in units of pixels. The inverting cycle is set to be equal to one horizontal scanning period or a dot clock cycle. In the present embodiment, for ease of illustration, data signals are inverted in polarity, by way of example but not as a limitation of the present invention, in units of scanning lines. Furthermore, in the example of the liquid crystal display device shown in FIG. 1, phase-expanded image signals VID1–VID6 are simultaneously supplied to the liquid crystal display panel 100. However, they may be supplied one after another in synchronization with the dot clock. In this case, the N-phase image signals are sequentially sampled by the sampling circuit as will be described in detail later.

The precharge signal supply circuit 400 inverts the polarity of a precharge signal NRS and supplies the resultant signal to the liquid crystal display panel 100 with timing specified by the timing generator 200. The polarity of the precharge signal NRS is set by the precharge signal supply circuit 400 immediately before a precharge driving signal NRG which will be described later rises up to a high level, such that the precharge signal NRS has the same polarity as that of an image signal applied to a data line. In the present embodiment, the inversion of polarity refers to a process of alternately inverting a voltage level between positive and negative polarities with reference to an arbitrary DC voltage level (equal to the center potential of the amplitude of the image signal).

Construction of Liquid Crystal Display Panel

Figure 2:
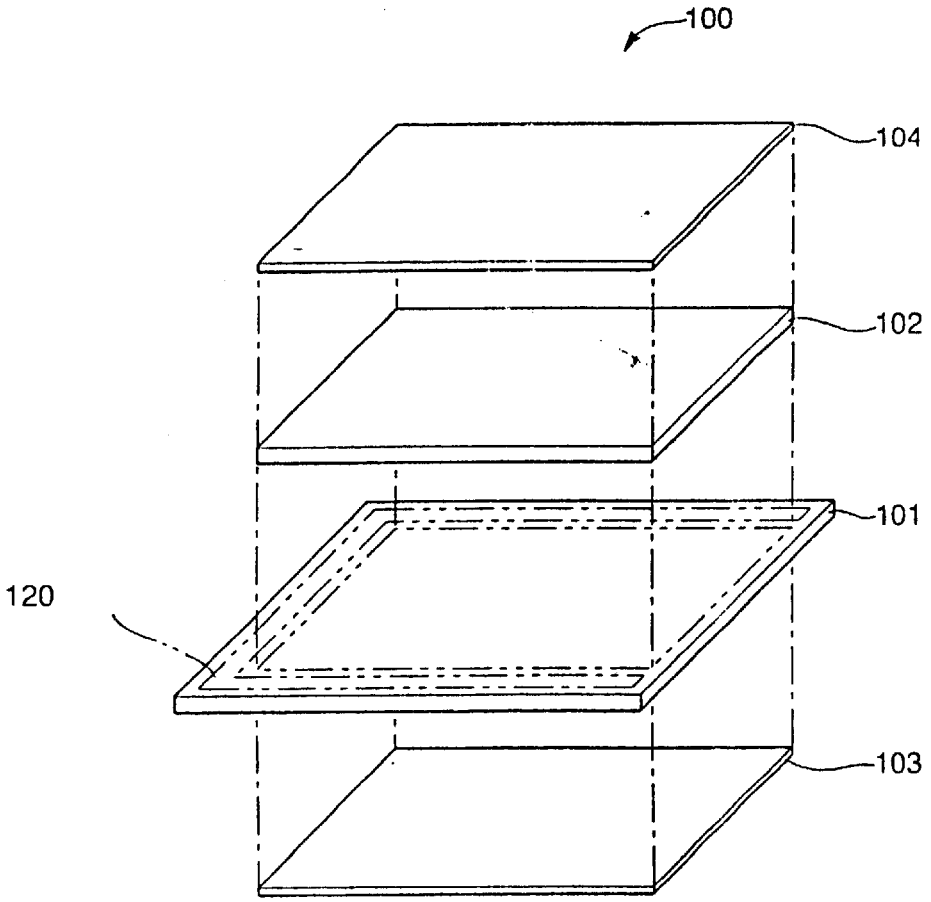
FIG. 2 is a perspective view illustrating the structure of the liquid crystal display panel of the liquid crystal display device.
Figure 3:
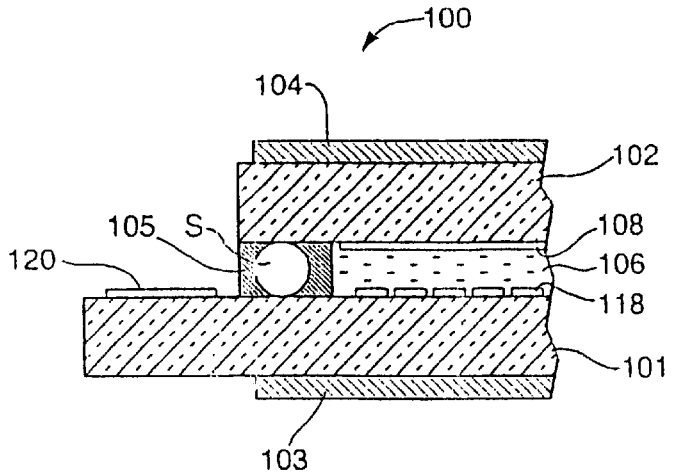
FIG. 3 is a partial cross-sectional view illustrating the structure of the liquid crystal display panel.

Referring now to FIGS. 2 and 3, the general construction of the liquid crystal display panel 100 is described below. FIG. 2 is a perspective view illustrating the structure of the liquid crystal display panel 100, and FIG. 3 is a partial cross-sectional view illustrating the structure of the liquid crystal display panel 100. As shown in these figures, the liquid crystal display panel 100 in this embodiment includes a device substrate 101, such as a glass or semiconductor substrate on which pixel electrodes 118 are formed, and a transparent opposite substrate 102, such as a glass substrate on which a common electrode 108 is formed. These substrates are adhesively bonded to each other via a sealing material 105 including a spacer S such that the surfaces on which electrodes are formed face each other, and a liquid crystal 106 is disposed in sealed fashion in a space between the two substrates.

On the device substrate 101, in an area outside the sealing material 105 and on the surface facing the opposite substrate 102, there are provided external connection electrodes (not shown) as well as driving circuits 120, which will be described below, so that various signals are input via the external connection electrodes from the timing generator 200, the image signal processing circuit 300, and the precharge signal supply circuit 400. The common electrode 108 of the opposite substrate 102 is electrically connected to an interconnection line extending from an external connection electrode on the device substrate 101, via an electrical connection member formed at least at one of four corners of the area adhesively bonded to the device substrate 101.

Other elements may be formed on the opposite substrate 102, depending on a specific application of the liquid crystal display panel 100. They include, for example, a color filter disposed in the form of stripes, in a mosaic form or in the form of triangles, a black matrix made of a metal such as chromium or nickel or made of resin black consisting of a photoresist in which carbon or titanium is dispersed, and a backlight for illuminating the liquid crystal display panel 100 with light. When the liquid crystal panel is used to modulate a colored light ray, no color filter is formed but a black matrix is formed on the opposite substrate 102. In addition, an alignment film rubbed in an arbitrary direction is formed on the opposing surfaces of the device substrate 101 and the opposite substrate 102, respectively, and polarizers 103 and 104 are disposed, depending on the alignment direction, directly or via a gap on the back surfaces of the respective substrates 101 and 102. However, when the liquid crystal 108 is formed of a macromolecular dispersion liquid crystal containing fine particles dispersed among macromolecules, the alignment films and the polarizers are not necessary. This allows an increase in the light utilization efficiency and thus an increase in the brightness and a reduction in power consumption.

Referring again to FIG. 1, the electrical construction of the liquid crystal display panel 100 is described. The device substrate 101 of the liquid crystal display panel 100 includes a plurality of scanning lines 112 extending in parallel in an X direction. A plurality of data lines 114 are formed on the device substrate 101 such that they extend in parallel in a Y direction perpendicular to the X direction. At intersections between the scanning lines 112 and the data lines 114, the gate electrodes of respective TFTs 116 are connected to the corresponding scanning electrodes 112, and source electrodes of the respective TFTs 116 are connected to the corresponding data lines 114. The drain electrodes of the respective TFTs 116 are connected to the corresponding pixel electrodes 118. Each pixel is formed of one pixel electrode 118, the common electrode 106 formed on the opposite substrate 102, and the liquid crystal 108 disposed between the pixel electrode 118 and the common electrode 106. Thus, pixels are disposed, in a matrix fashion, at locations corresponding to the respective intersections between the scanning lines 112 and the data lines 114. Furthermore, each pixel has its own storage capacitor (not shown) electrically connected in parallel to the liquid crystal layer disposed between the pixel electrode 118 and the common electrode 106.

The driving circuits 120 include a scanning line driving circuit 130, a sampling circuit 140, a data line driving circuit 150, and a precharging circuit 170, which are all formed, as described earlier, on the device substrate 101. These circuits are preferably formed of TFTs produced using the same production process (such as a high-temperature polysilicon process) as that used to produce the TFTs of the pixels. This is advantageous in terms of integration and production cost.

Of the driving circuits 120, the scanning line driving circuit 130 includes a shift register circuit and serves to sequentially output scanning signals to the respective scanning lines 112 in accordance with a clock signal CLY and an inverted clock signal $CLY_{INV}$ generated by the timing generator 200, and a transfer start pulse DY wherein a scanning signal is output when the shift register circuit shifts a pulse DY in response to a clock signal.

The sampling circuit 140 samples the image signals VID1–VID6 in response to sampling signals S1–Sn and supplies the resultant signals to data lines 114 on a group-by-group basis wherein each group consists of six data lines 114. More specifically, the sampling circuit 140 includes switches 141 formed of TFTs each connected to one end of each data line 114. The source electrode of each switch 141 is connected to one signal line via which one of the image signals VID1–VID6 is supplied. The drain electrode of each switch 141 is connected to one of data lines 114. The gate electrodes of the switches 141 connected to the respective data lines 114 belonging to one group are connected to respective signal lines via which sampling signals S1–Sn are supplied depending on the group. Because the image signals VID1–VID6 are supplied at the same time as described above, they are sampled at the same time in response to a sampling signal S1. However, in the case where the image signals VID1–VID6 are supplied at different times, they are sequentially sampled in response to sampling signals S1, S1, . . . .

The data line driving circuit 150 sequentially outputs sampling signals S1–Sn in accordance with the clock signal CLX and the inverted clock signal CLX,NV generated by the timing generator 200, and the transfer start pulse DX. The details of the data line driving circuit 150 will be described below.

The capacitive component of each data line 114 results in a delay in writing the image signals VID1–VID6 sampled by the respective switched 141 into pixels by the respective TFTs 116. To minimize the delay, there is provided the precharging circuit 170 including switches each connected to the other ends of the respective data lines 114. These switches 171 are also realized by TFTs formed on the device substrate 101. The drain electrode (or source electrode) of each switch 171 is connected to one of data lines 114, and the source electrode (or drain electrode) is connected to a signal line via which the precharge signal NRS is supplied. The gate electrode of each switch 171 is connected to a signal line via which the precharge driving signal NRG is supplied.

The precharge driving signal NRG is supplied from the timing generator 200. The precharge driving signal NRG is a pulse signal which becomes high during a horizontal blanking period from the end of each selection period in which one scanning line is selected until the start of a following selection period in which the next scanning line is selected. In response to the precharge driving signal NRG, all data lines 114 are simultaneously precharged to the potential of the precharge signal NRS during each horizontal blanking line. Although it is desirable that the voltage of the precharge driving signal NRG be equal in polarity to the image signals which will be applied to the respective data lines 114 immediately after the precharge driving signal NRG, the voltage of the precharge driving signal NRG may be equal to a polarity-alternating reference potential.

Construction of the Data Line Driving Circuit

Figure 4:
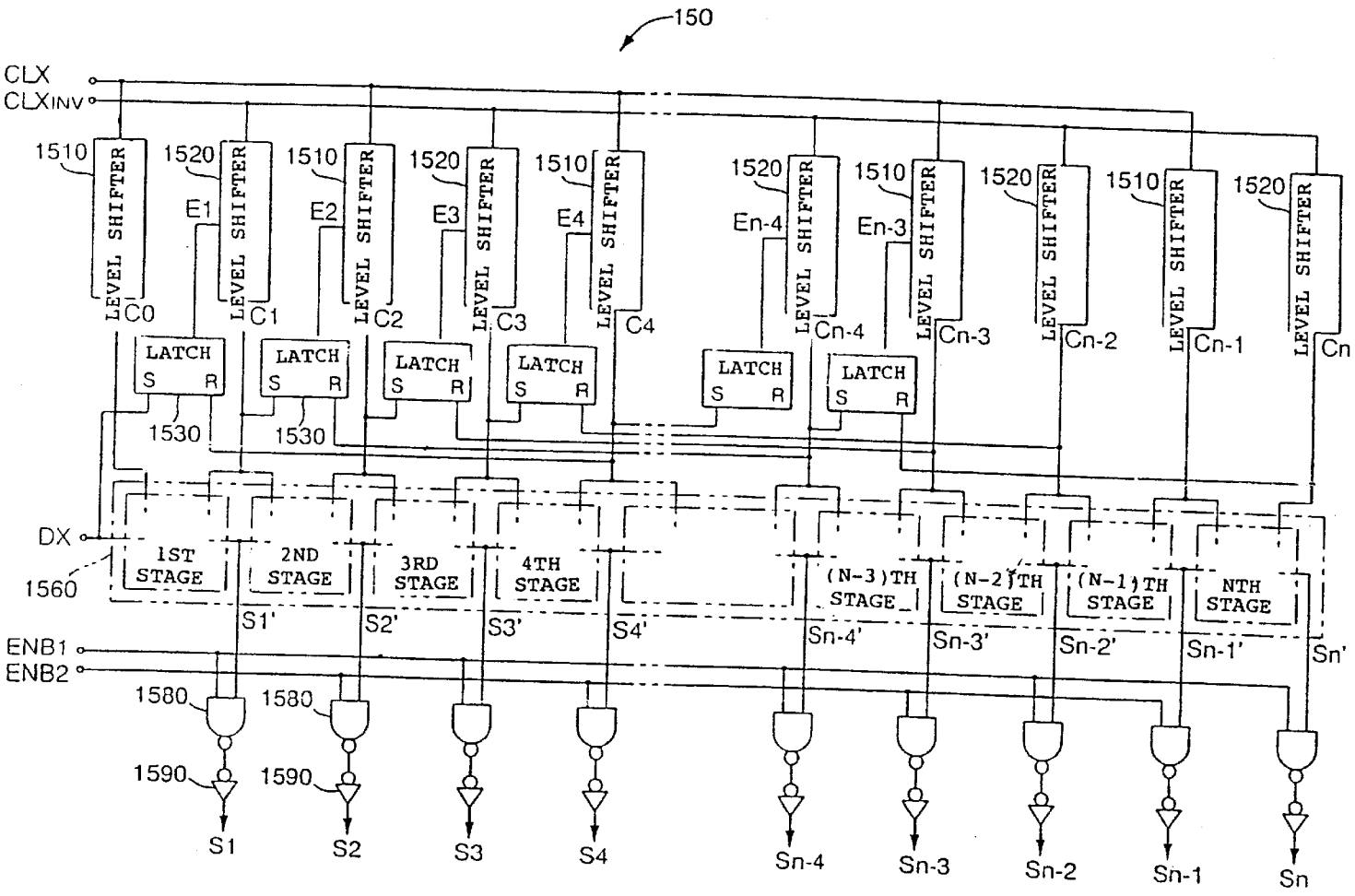
FIG. 4 is a block diagram illustrating the construction of the data line driving circuit of the liquid crystal display panel.

The data line driving circuit 150 of the present embodiment is described below. FIG. 4 is a block diagram illustrating the construction of the data line driving circuit 150. In FIG. 4, the clock signal CLX, the inverted clock signal $CLX_{INV}$, the transfer start pulse DX, and signals ENB1 and ENB2 are all supplied from the timing generator 200 shown in FIG. 1 in synchronization with the image signals VID1–VID6. Of these signals, the transfer start pulse DX and the signals ENB1 and ENB2 are supplied after being converted by level shifters (not shown) into the form of large logic swing signals.

In FIG. 4, a shift register circuit 1560 includes n unit circuits connected in a cascade fashion where n is an odd number. A transfer start pulse DX is input to the shift register circuit 1560 at the start of each horizontal scanning period, and the transfer start pulse DX is shifted through the cascaded unit circuits from a stage to another in response to signals C0–Cn which are parts of the clock signal CLX and the inverted clock signal $CLX_{INV}$ level-shifted into the form of large clock swing signals, and the resultant shifted signals are output as signals S1'–Sn'. Each unit circuit is formed of a flip-flop and a latch or a capacitor such that a pulse DX output from a preceding stage is stored in response to a clock signal and output to a following stage in response to a next clock signal.

Each of level shifters 1510 and 1520 for converting the logic swing voltage level of the clock signals are disposed at locations corresponding to the unit circuits at the respective stages of the shift register circuit 1560. Of these two types of level shifters, each level shifter 1510 serves to convert the clock signal CLX with the small logic swing supplied from the timing generator 200 shown in FIG. 1 into a signal with the large logic swing and supply the resultant signal to an even-numbered unit circuit and an immediately following odd-numbered unit circuit. On the other hand, each level shifter 1520 convert the inverted clock signal $CLX_{INV}$ with the small logic swing supplied from the timing generator 200 into a signal with the large logic swing and supply the resultant signal to an odd-numbered unit circuit and an immediately following even-numbered unit circuit. However, the level shifter 1510 at the leftmost location in FIG. 4 converts the clock signal CLX with the small logic swing to a signal C0 with the large logic swing and supplies it only to the unit circuit at the first stage. The level shifter 1520 at the rightmost location in FIG. 4 converts the inverted clock signal $CLX_{INV}$ with the small logic swing to a signal Cn with the large logic swing and supplies it only to the unit circuit at the nth stage. Therefore, in the present embodiment, the total number of level shifters 1510 and 1520 is greater by one than the number, n, of unit circuits of the shift register circuit 1560. For convenience of illustration, the signals with the large logic swing output from the respective shift register circuits 1510 and 1520 arranged from the left to the right in FIG. 4 are denoted by C0, C1, . . . , Cn−1, Cn, respectively.

Figure 6:
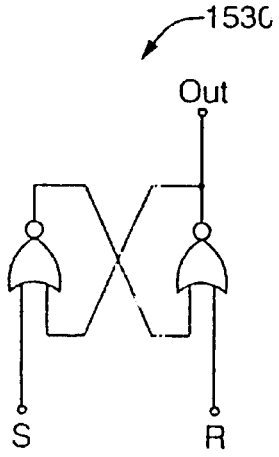
FIG. 6 is a circuit diagram illustrating an example of the circuit configuration of a latch circuit used in the data line driving circuit.

The level shifters 1510 and 1520 receive a signal output from a latch circuit 1530 formed of, for example, an RS flip-flop shown in FIG. 6 wherein the signal serves as an enable signal which enables the level shifters to operate. The set input S of a latch circuit 1530 which outputs an enable signal to a certain level shifter is coupled to the output of the level shifter located immediately before (at the left side of) the certain level shifter, and the reset input R of that latch circuit is coupled to the output of the level shifter located three stages (at the right side) behind the certain level shifter. Therefore, if a signal with the large logic swing is output from the level shifter located immediately ahead of a certain level shifter, then the certain level shifter is enabled. On the other hand, if a signal with the large logic swing is output from the level shifter located three stages behind the certain level shifter, then the certain level shifter is disabled.

However, the latch 1530 serving to supply an enable signal to the level shifter 1520 which outputs the signal C1 is set by the transfer start pulse DX. On the other hand, the level shifter 1510 which outputs the signal C0 has no level shifter disposed immediately ahead of it, and the level shifters 1510 and 1520 which output the signals Cn−2, Cn−1, and Cn, respectively, have no level shifters located three stages behind them, and thus there are no latch circuit 1530 coupled to these level shifters. Therefore, in the present embodiment, the total number of latch circuits 1530 is smaller by 4 than the total number of level shifters of the shift register circuit 1560 and thus smaller by 3 than the number of stages of unit circuits of the shift register 1560. For convenience of illustration, the enable signals applied to the level shifters which outputs the signal C1, . . . , Cn−3 are denoted by E1, E2, . . . , En−4, and En−3, respectively. In the present embodiment, the four level shifters having no corresponding latch circuits 1530 are always enabled to operate.

NAND circuits 1580 and inverters 1590 are disposed such that one NAND circuit 1580 is coupled with the output of each stage of unit circuit of the shift register circuit 1560 and one inverter 1590 is coupled with the output of that NAND circuit 1580. The NAND circuits 1580 and the inverters 1590 are formed of p-channel TFTs or a combination of p-channel and n-channel TFTs. Each odd-numbered NAND circuit 1580 serves to output an inverted signal of the logical AND between the signal ENB1 and the output signal of the corresponding odd-numbered unit circuit. Each even-numbered NAND circuit 1580 serves to output an inverted signal of the logical AND between the signal ENB2 and the output signal of the corresponding even-numbered unit circuit. The output signals of the NAND circuits 1580 at respective stages are inverted by the corresponding inverters 1590 and output as sampling signals S1, S2, . . . , Sn.

Level Shifter

Figure 5:
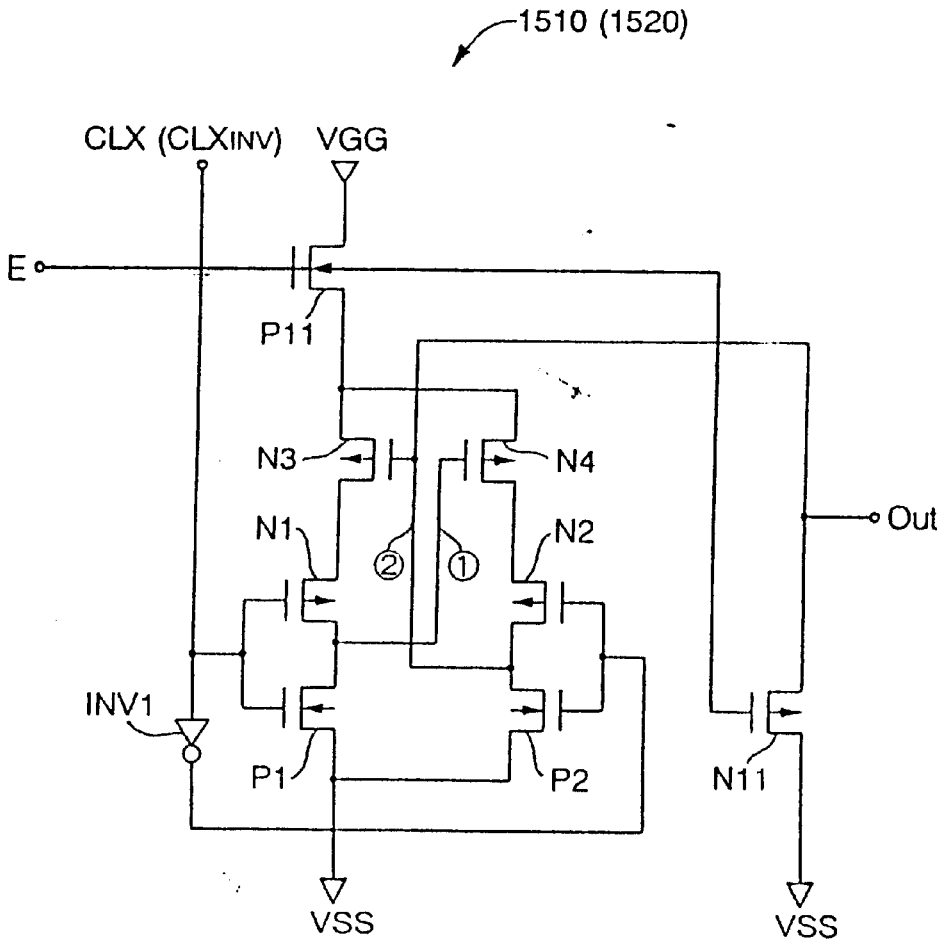
FIG. 5 is a circuit diagram illustrating an example of the circuit configuration of a level shifter used in the data line driving circuit.

The constructions of the level shifters 1510 and 1520 are described below. Herein, a level shifter 1510 which converts the clock signal CLX with the small logic swing to a signal with the large logic swing is taken as an example. FIG. 5 illustrates an example of a circuit configuration of the level shifter 1510. Each level shifter 1520 for converting the inverted clock signal $CLX_{INV}$ with the small logic swing to a signal with the large logic swing is similar to the level shifter 1510 except that the clock signal CLX is replaced with the inverted clock signal $CLX_{INV}$.

In the level shifter 1510, as can be seen from FIG. 5, when the enable signal supplied to the terminal E is at a high level, the voltages on the signal lines (1) and (2) become settled at either a high-level voltage VGG or a low-level voltage VSS of the large logic swing depending on the clock signal CLX with the small logic swing and the signal inverted by the inverter INV1. Of these voltages, the voltage on the signal line (2) is output via the output terminal OUT from the level shifter 1510.

More specifically, if the enable signal becomes high, a p-channel transistor P11 is turned on. Herein, if the clock signal CLX with the small logic swing given as an input signal is at the high level, then a p-channel transistor P1 is also turned on. As a result, the voltage on the signal line (1) becomes equal to the low-level voltage VSS of the large logic swing and thus an n-channel transistor N4 is turned on. On the other hand, the clock signal CLX is inverted by the inverter INV1 and the inverted signal at the low level is applied to the gate of an n-channel transistor N2. As a result, the n-channel transistor N2 is turned on, and thus the voltage on the signal line (2) becomes equal to the high-level voltage VGG of the large logic swing. As a result, the n-channel transistor N3 is turned off. Herein, because the clock signal CLX is at the high level, an n-channel transistor N1 is also turned off, and thus the signal line (1) is absolutely isolated from the high-level voltage VGG of the large logic swing and the voltage of the signal line (1) is settled at the low-level voltage VSS of the large logic swing. On the other hand, because the inverted clock signal at the low level obtained via the inverter INV2 is applied to the gate of a p-channel transistor P2, the p-channel transistor P2 is turned off. As a result, the signal line (2) is absolutely isolated from the low-level voltage VSS of the large logic swing, and the potential of the signal line (2) is settled at the high-level voltage VGG of the large logic swing.

Conversely, if the clock signal CLX with the small logic swing given as the input signal is at the low level, then the transistors P1, P2, and N1–N4 are all brought into opposite states. As a result, the potential of the signal line (1) is settled at the high-level voltage VGG of the large logic swing, and the potential of the signal line (2) is settled at the low-level voltage VSS of the large logic swing.

When the enable signal is at the high level, an n-channel transistor N11 is turned off, and thus the potential of the signal line (2) is directly output via the output terminals OUT. That is, in this case, the output signal output via the output terminal OUT becomes equal to a voltage obtained by level-shifting the clock signal CLX with the small logic swing to a signal with the large logic swing in the same phase.

On the other hand, when the enable signal is at the low level, the transistor P11 is turned off and the transistor NI I is turned on. As a result, the potential of the output terminal OUT becomes equal to the low-level voltage VSS regardless of the potential of the signal line (2). That is, level-shifting is disabled.

In the level shifter 1510 (1520), when the enable signal is at the high level, if the clock signal CLX ($CLX_{INV}$) with the small logic swing is at the high or low level, then the voltages of the signal lines (1) and (2) are settled at the high-level voltage VGG or the low-level voltage VSS of the large logic swing depending on the clock level. Thus, substantially no power is consumed by the level shifter 1510 (1520). That is, in the level shifter 1510 (1520), when the enable signal is at the high level, power is consumed only in a transition period during which the level of the clock signal CLX ($CLX_{INV}$) changes. Therefore, the power consumption of the level shifter 1510 (1520) increases with the frequency of the clock signal CLX ($CLX_{INV}$) with the small logic swing input to the level shifter 1510 (1520). However, when the enable signal is at the low level, the transistor P11 is turned off and the transistor N11 is turned on, and thus level shifting is disabled. In this state, the level shifter 1510 (1520) consumes substantially no electric power.

As described earlier, each transistor of the level shifter 1510 (1520) is also formed of a TFT.

Shift Register Circuit

Figure 7:
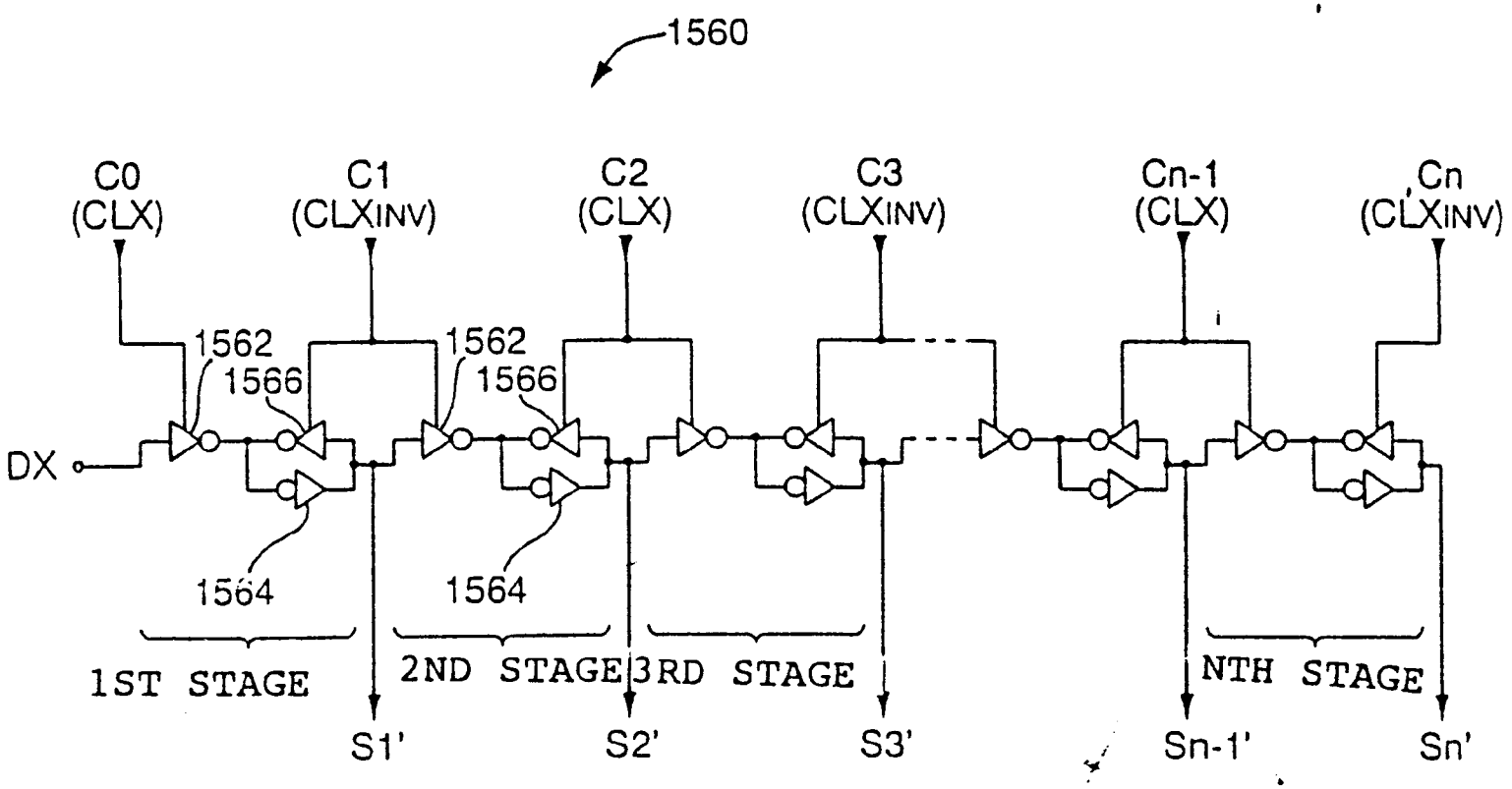
FIG. 7 is a circuit diagram illustrating an example of the circuit configuration of a shift register circuit used in the data line driving circuit.

Referring now to FIG. 7, the shifter register 1560 is described in further detail below. As shown in FIG. 7, the shift register circuit 1560 includes n unit circuits connected in a cascade fashion. Each unit circuit includes a clocked inverter 1562 which inverts a given input signal when a control signal is at a high level, an inverter 1564 which inverts an inverted signal output from the clocked inverter 1562, and a clocked inverter 1566 which inverts an inverted signal output from the inverter 1564 when a control signal is at a high level. The clocked inverters 1562 and 1566 and the inverter 1564 are formed of combinations of p-channel and n-channel TFTs.

The output of the inverter 1564 is fed back to the input of the clocked inverter 1566, and the output of the clocked inverter 1566 is fed back to the input of the inverter 1564. The outputs of the inverters 1564 at the respective stages are output as the output signals S1', S2', . . . , Sn' of the shift register circuit 1560.

The signals C2, C4, . . . , Cn−3, and Cn−1 level-shifted by the level shifters 1510 are supplied as control signals to the clocked inverters 1566 of the unit circuits at the even-numbered stages and to the clocked inverters 1562 of the unit circuits at the odd-numbered stages. On the other hand, the signals C1, C3, . . . , Cn−4, and Cn−2 level-shifted by the level shifters 1520 are supplied as control signals to the clocked inverters 1562 of the unit circuits at the odd-numbered stages and to the clocked inverters 1566 of the unit circuits at the even-numbered stages. That is, the control signals applied to the clocked inverters 1562 and 1566 of the unit circuits at the respective even-numbered stages are opposite to the control signals applied to the clocked inverters 1562 and 1566 of the unit circuits at the respective odd-numbered stages. However, the signal C0 is applied as a control signal only to the clocked inverter 1562 of the unit circuit at the first stage, and the signal Cn is applied as a control signal only to the clocked inverter 1566 of the unit circuit at the nth stage,

Data Line Driving Circuit

Figure 8:
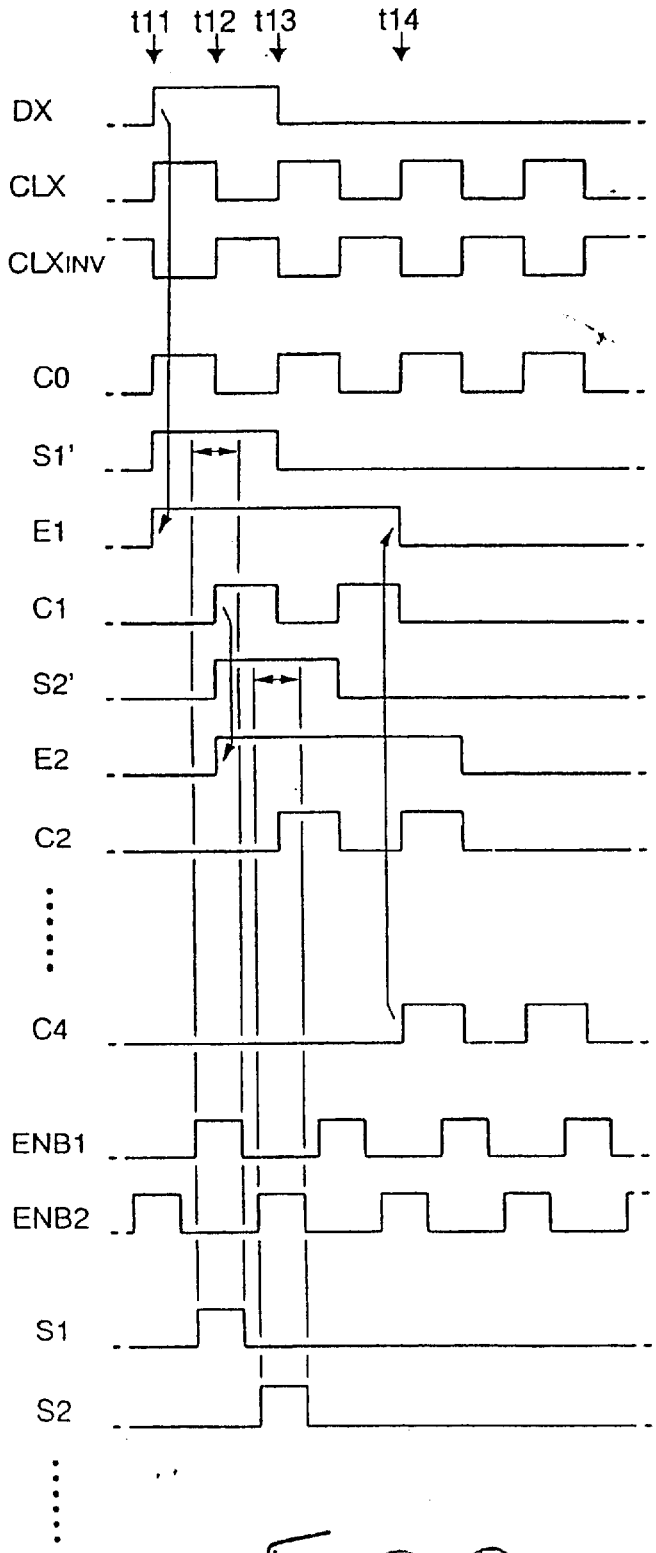
FIG. 8 is a timing chart illustrating the operation of the data line driving circuit.

Referring to the timing chart shown in FIG. 8, the operation of the data line driving circuit 150 constructed in the above-described manner is described below. Although in FIG. 8, the clock signal CLX and the inverted clock signal $CLX_{INV}$ are represented for convenience of illustration as if they had the same logic swing as the large logic swing of the other signals, the actual logic swings of the clock signal CLX and the inverted clock signal $CLX_{INV}$ are small.

The level shifter 1510 at the leftmost location in FIG. 4 is always in an enabled state, and the clock signal CLX with the small logic swing is converted into a signal with the large logic swing at the same logic level as that of the clock signal CLX, and the resultant signal is output as the output signal C0.

When a transfer start pulse DX is input at time t11, if the clock signal CLX with the small logic swing rises up (the inverted clock signal $CLX_{INV}$ with the small logic swing falls down), the signal C0 with the same phase as that of clock signal CLX also rises up. Therefore, in the shift register circuit 1560, the clocked inverter 1562 of the unit circuit at the first stage inverts the high-level transfer start pulse DX, and the clocked inverter 1564 of the unit circuit at the first stage inverts the output of the above clocked inverter 1562. As a result, the output signal S1' of the unit circuit at the first stage becomes high. When the transfer start pulse DX is set, the enable signal E1 becomes high, and the level shifter 1520 at the second location as counted starting from the leftmost in FIG. 4 is enabled. As a result, during the period in which the enable signal E1 is at the high level, the output signal C1 of this level shifter 1520 is given by converting the inverted clock signal $CLX_{INV}$ with the small logic swing into a signal with the large logic swing in the same phase as the inverted clock signal $CLX_{INV}$.

If the inverted clock signal $CLX_{INV}$ with the small logic swing rises up (the clock signal CLX with the small logic swing falls down) at time t12 during the period in which the transfer start pulse DX is applied, then the signal C1 in the same phase as the inverted clock signal $CLX_{INV}$ also rises up. In response to the signal C1 rising up to the high level, the clocked inverter 1566 of the unit circuit at the first stage inverts the output signal S1' at the high level and feeds the resultant signal back to the inverter 1564. As a result, the output signal S1' is maintained at the high level. On the other hand, in response to the signal C1 rising up to the high level, the clocked inverter 1562 of the unit circuit at the second stage inverts the high-level signal S1' output from the unit circuit at the first stage, and the inverter 1564 of the unit circuit at the second stage inverts the output of the above clocked inverter 1562. As a result, the output signal S2' of the unit circuit at the second stage becomes high. Furthermore, when the signal C1 is set, the enable signal E2 becomes high, and the level shifter 1510 at the third location as counted starting from the leftmost in FIG. 4 is enabled. As a result, during the period in which the enable signal E2 is at the high level, the output signal C2 of this level shifter 1510 is given by converting the clock signal CLX with the small logic swing into a signal with the large logic swing in the same phase as the clock signal CLX.

When the transfer start pulse DX falls down at time t13, if the clock signal CLX with the small logic swing again rises up (the inverted clock signal $CLX_{INV}$ with the small logic swing fall down), the low-level transfer start pulse DX is input into the clocked inverter 1562 of the unit circuit at the first stage. As a result, the output signal S1' of this unit circuit becomes low. On the other hand, in response to the high-level signal C2, the clocked inverter 1566 of the unit circuit at the second stage inverts the output signal S2' at the high level and feeds the resultant inverted signal back to the inverter 1564. As a result, the output signal S2' is maintained at the high level.

Furthermore, in response to the high-level signal C2, the clocked inverter 1562 of the unit circuit at the third stage inverts the output signal S2' at the high level, and the inverter 1564 of the unit circuit at the second stage inverts the output of the above clocked inverter 1562. As a result, the output signal S3' (not shown in FIG. 8) of the unit circuit at the third stage becomes high.

The operation is continued in a similar manner, and thus the initially input transfer start pulse DX is sequentially shifted every one-half period of the clock signal CLX with the small logic swing or the inverted clock signal $CLX_{INV}$, and output as the output signals S1'–Sn' from the unit circuits at the respective stages.

Of the output signals S1'–Sn', the output signals of the unit circuits at the odd-numbered stages are limited by the corresponding NAND circuits 1580 to the same pulse width as that of the signal ENB1, and the output signals of the unit circuits at the even-numbered stages are limited by the corresponding NAND circuits 1580 to the same pulse width as that of the signal ENB2, thereby ensuring that immediately adjacent signals do not become high at the same time.

If adjacent sampling signals are output at the same time, the switches 141 belonging to adjacent groups will be turned on at the same time, and the image signals VID1–VID6 will be sampled in periods overlapping between adjacent groups of data lines 114. Such a problem is avoided by outputting the signals in the above-described manner. In the case where the frequency of the clock signal CLX and the inverted clock signal $CLX_{INV}$ is set to a low value, and the sampling signals S1–Sn are output such that there is substantially no overlap between adjacent signals, then the data line driving circuit 150 does not need the NAND circuits 1580 serving to limit the pulse width and the inverters 1590.

The enable signals E1 to En–3 are sequentially raised to the high level as the transfer start pulse DX is sequentially shifted every one-half period of the clock signal CLX and the inverted clock signal $CLX_{INV}$ with the small logic swing. In response to these enable signals E1 to En–3, the level shifters 1510 and 1520 are enabled. As described earlier, the operation of these level shifters are disabled when the output signal of the level shifter located three stages behind becomes high. For example, in FIG. 4, the level shifter 1520 at the second location counted from the left is disabled when the enable signal E1 falls down to the low level wherein the falling down of the enable signal E1 occurs when the level shifter 1510 located three stages behind the level shifter 1520 of interest is enabled and thus the output signal C4 thereof becomes high at time t14 shown in FIG. 8 thereby resetting the latch 1530 coupled with the level shifter 1520 of interest. After that, this level shifter 1520 remains in the disabled state until it is enabled in the next horizontal scanning period.

Scanning Line Driving Circuit

The scanning line driving circuit 130 is described below. The construction of the scanning line driving circuit 130 is basically the same as that of the data line driving circuit 150 except that the input signals are different. That is, in FIG. 4, instead of the transfer start pulse DX which is supplied at the start of each horizontal scanning period, a transfer start pulse DY is input at the start of each vertical scanning period. Furthermore, instead of the clock signal CLX and the inverted clock signal $CLX_{INV}$, a clock signal CLY and an inverted clock signal $CLY_{INV}$ both having the small logic swing are input every horizontal scanning period. These clock signal CLY, the inverted clock signal $CLY_{INV}$, and the transfer start pulse DY are supplied from the timing generator 200 shown in FIG. 1 in synchronization with the image signals VID1–VID6. Of these signals, the transfer start pulse DY is supplied after being converted by a level shifter (not shown) so as to have the large logic swing. In the case where the frequency of the clock signal CLY and the inverted clock signal $CLY_{INV}$ is set to a low value so that scanning signals supplied to adjacent scanning lines have in effect no overlap between each other, then, as in the data line driving circuit 150, the scanning line driving circuit 130 does not need the NAND circuits 1580 serving to limit the pulse width and the inverters 1590.

Overall Operation of the Liquid Crystal Display Panel

The operation of the liquid crystal display panel constructed in the above described manner is described below. First, at the start of a vertical scanning period, a transfer start pulse DY is supplied to the scanning line driving circuit 130. In the scanning line driving circuit 130, the transfer start pulse DY is sequentially shifted in response to the clock signal CLY and the inverted clock signal $CLY_{INV}$ and output over the respective scanning lines 112 thereby sequentially selecting the scanning lines 112 on a line-by-line basis.

The precharge driving signal NRG becomes high during a horizontal blanking period from the end of a selection period in which a certain scanning line is selected until the start of the next selection period in which the next scanning line is selected and image signals are applied to the data lines, and thus the respective data lines 114 are precharged by the potential of the precharge signal line NRS via the respective switches 171.

After that, if a transfer start pulse DX is supplied to the data line driving circuit 150, then the transfer start pulse DX is sequentially shifted in the data line driving circuit 150, as described above, every one-half period of the clock signal CLX and the inverted clock signal $CLX_{INV}$ and output as the sampling signals S1–Sn.

When the sampling signal S1 is output, the six data lines 114 corresponding to the group coupled with the sampling signal S1 are supplied with sampled image signals VID1–VID6. As a result, the image signals VID1–VID6 are written via corresponding TFTs 116 into six pixels located at intersections between the currently selected scanning line and the six data lines 114. After that, when the sampling signal S2 is output, sampled image signals VID1–VID6 are supplied to the six data lines 114 corresponding to the next group, and the image signals VID1–VID6 are written via corresponding TFTs 116 into six pixels located at intersections between the currently selected scanning line and the six data lines 114 of the next group.

Similarly, the sampling signals S3, S4, . . . , Sn are sequentially output, and sampled image signals VID1–VID6 are supplied to the six data lines 114 belonging to the groups coupled with the respective sampling signals so that the image signals VID1–VID6 are written into six pixels located at intersections between the currently selected line and the six data lines 114. After that, the next scanning line is selected, and the data lines 114 are precharged. The sampling signals S1–Sn are then sequentially output, and the writing operation is performed in a similar manner.

In the driving method described above, the data line driving circuit 150 serving to drive the switches 141 of the sampling circuit 140 can be formed in a simple fashion. More specifically, the number of stages of the shift register circuit 1560 shown in FIG. 4 can be reduced to one-sixth the number of stages required in the method in which data lines 114 are driven on a dot-by-dot basis. Furthermore, the frequency of the clock signal CLX and the inverted clock signal $CLX_{INV}$ supplied to the data line driving signal 150 becomes one-sixth the frequency required when the data lines 114 are driven on a dot-by-dot basis. Thus, not only the reduction in the number of stages, but a reduction in power consumption can be achieved. Furthermore, the respective data lines 114 are first precharged via the switches 171 by the voltage of the precharge signal line NRS, and then the voltages of the image signals VID1–VID6 sampled by the switches 141 are supplied to the data lines 114. Because the potentials of the image signals are equal in polarity to the precharging potential, the amounts of charging or discharging associated with the image signals VID1–VID6 on the data lines 114 become smaller, and thus the time required for the writing becomes shorter.

In the liquid crystal display panel 100, the data line driving circuit 150 is supplied with the clock signal CLX and the inverted clock signal $CLX_{INV}$ having the highest frequency. However, because the data line driving circuit 150 includes the level shifters 1510 and 1520 coupled with the corresponding unit circuits of the shift register circuit 1560 as shown in FIG. 4, the length of lines used to supply the clock signal CLX and the inverted clock signal $CLX_{INV}$ becomes very small compared with the case where these clock signals are directly supplied to all stages of unit circuits of the shift register circuit 1560. This results in a reduction in the capacitance associated with the lines via which signals with the large logic swing are supplied, and thus electric power consumed by the capacitance can be reduced. On the other hand, it is required to supply the clock signal CLX and the inverted clock signal $CLX_{INV}$ with the small logic swing from the timing generator 200 to the respective level shifters 1510 and 1520. This results in an increase in the capacitance associated with the lines via which signals with the small logic swing. However, because the voltage associated with such lines is small, electric power consumed by these lines is much smaller than that consumed by the lines used to supply signals with the large logic swing.

Furthermore, although there are as many shift register circuits 1510 or 1520 as there are unit circuits in the shift register circuit 1560, all these shift register circuits do not always operate. That is, the level shifters 1510 and 1520 are enabled by the enable signal immediately before (or at the same time as) the start of the transfer operation of the unit circuits to which the signal is supplied from the level shifters, and disabled immediately after (or at the same time as) the completion of the transfer operation of the unit circuits to which the signal is supplied from the level shifters. Therefore, only some of the level shifters are in operation at a time. Furthermore, in the present embodiment, the level shifters in operation supply a signal with the large logic swing only to two unit circuits at some stages of the shift register circuit 1560. Therefore, the electric power consumed by the level shifters is suppressed to a very low level.

Because the frequency of the clock signal CLY and the inverted clock signal $CLY_{INV}$ supplied every horizontal period is lower than the frequency of the clock signal CLX and the inverted clock signal $CLX_{INV}$, the power consumption of the scanning line driving circuit 130 is practically negligible. Besides, in the present embodiment, the scanning line driving circuit 130 is constructed in a similar form to that of the data line driving circuit 150, and thus the power consumption of the scanning line driving circuit 130 is further suppressed to an extremely low level.

In the present embodiment, the level shifters 1510 and 1520 which output the signals Cn−2, Cn−1, and Cn are always enabled to operate. Alternatively, there may be provided latch circuits corresponding to these level shifters in a similar manner for the other level shifters so as to enable these level shifters only within limited periods. In this case, the set input terminal S of each of these latch circuits is coupled with the output of the level shifter located immediately ahead of (at the left side of) the level shifter corresponding to the latch, as in the other latch circuits. However, there is no level shifter located three stages behind (at the right side of) the level shifter corresponding to the latch circuit. Thus, it is required that the signals C1, C2, and C3, the transfer start pulse DX, and the precharge driving signal NRG are directly applied. In this configuration, the level shifters are disabled during a period from the reset time to the set time when the next scanning line is selected, and thus electric power consumption further decreases.

In the above-described data line driving circuit 150 of the first embodiment, the transfer start pulse DX is sequentially shifted in one direction from left to right in FIG. 4. Similarly, also in the scanning line driving circuit 130, the scanning lines 112 are selected in one direction. However, some electrooptical device such as a liquid crystal display device has a mode in which an image is displayed in a vertically or horizontally inverted fashion. In such a case, the first embodiment cannot be directly applied to the liquid crystal display device. In this second embodiment, a driving circuit capable of displaying an image in a horizontally or vertically inverted fashion is disclosed.

Figure 9:
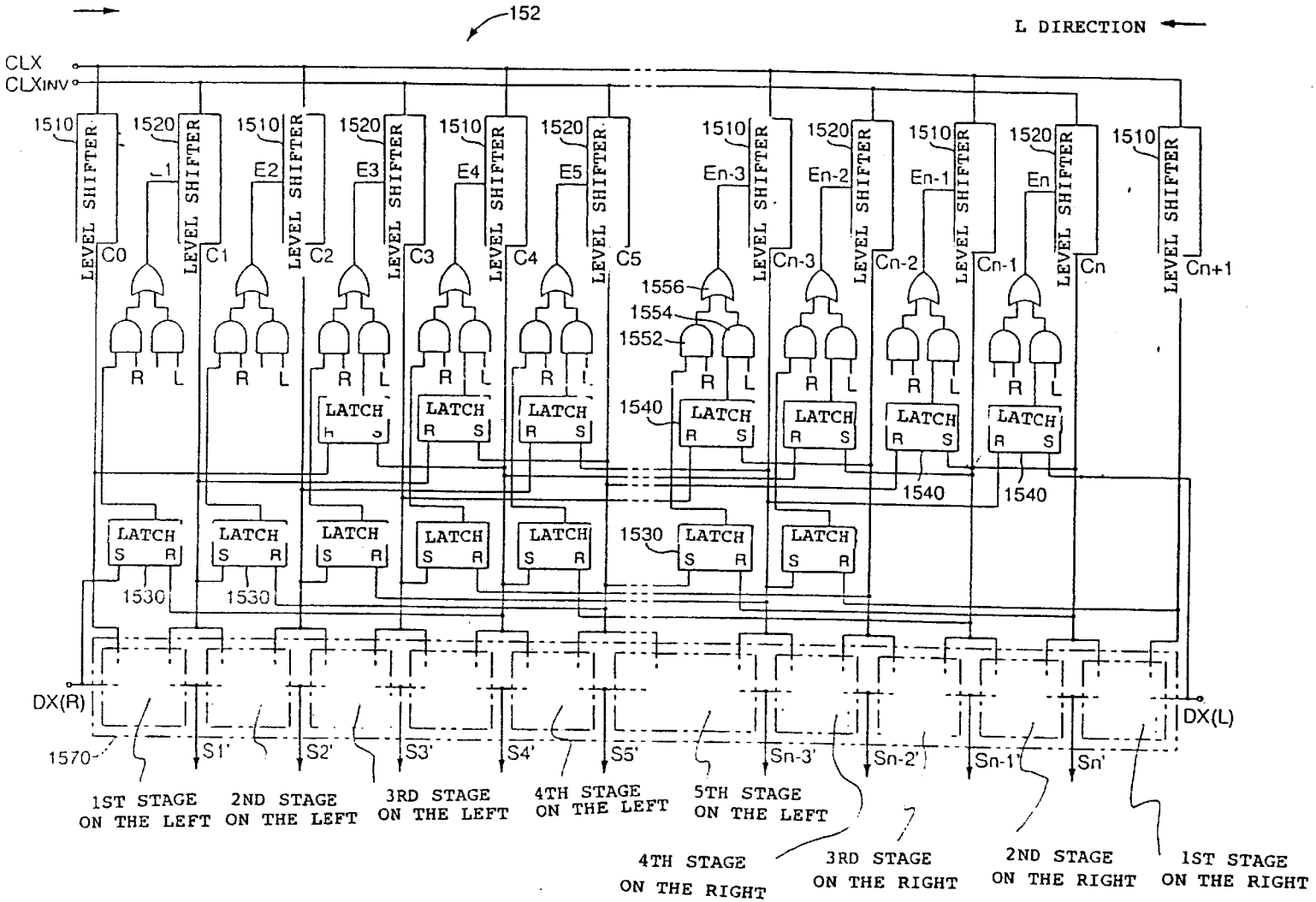
FIG. 9 is a block diagram illustrating a data line driving circuit which is one of driving circuits according to a second embodiment of the invention.

In this second embodiment, the data line driving circuit 150 shown in FIG. 4 is replaced with a data line driving circuit 152 shown in FIG. 9. In FIG. 9, similar parts to those in FIG. 4 are denoted by similar reference numerals, and they are not described in further detail. Note that NAND circuits 1580 and inverters 1590 corresponding to the respective unit circuits of the shift register circuit are not shown in FIG. 9.

In the data line driving circuit 152, when it is desired to output the output signals in the order S1', S2', . . . , Sn−1', Sn', the transfer start pulse DX(R) is transferred in the right (R) direction. On the other hand, when it is desired to output the output signals in the order Sn', Sn−1', . . . , S2', S1', the transfer start pulse DX(L) is transferred in the left (L) direction. In this circuit configuration, in order to allow the transfer operation to be performed in any desired direction in synchronization with the clock signal CLX with the large logic swing, the shift register circuit of the data line driving circuit 152 includes stages whose number is greater by one than in the data line driving circuit 150 according to the first embodiment. Correspondingly, there are provided level shifters whose number is also greater by one.

Figure 10:
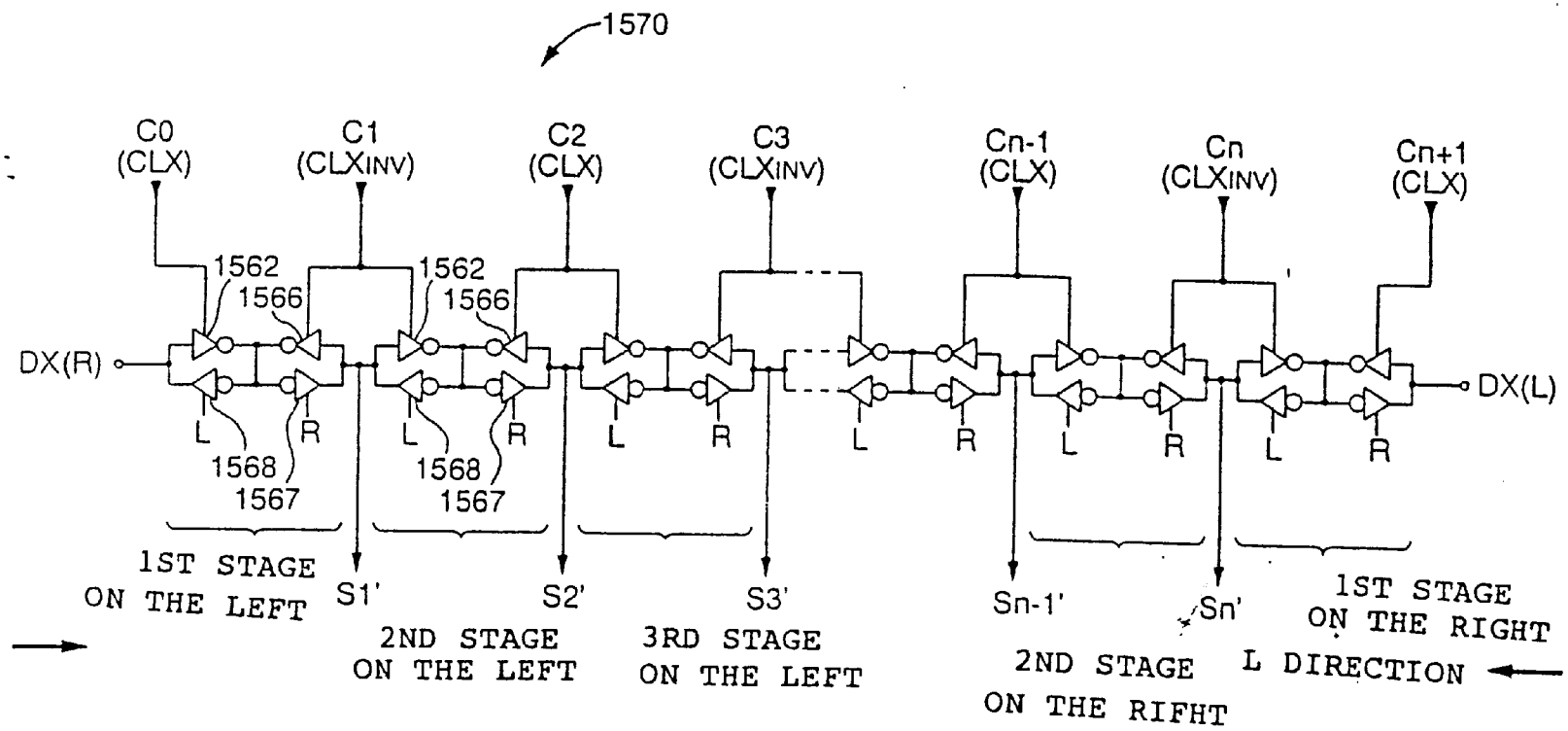
FIG. 10 is a circuit diagram illustrating an example of the circuit configuration of a shift register circuit used in the data line driving circuit shown in FIG. 9.

FIG. 10 illustrates the circuit configuration of the respective unit circuits forming the shift register circuit 1570 of the data line driving circuit 152 according to the second embodiment. As shown in FIG. 10, the shift register circuit 1570 includes (n+1) stages of unit circuits connected in a cascaded fashion. Each stage of unit circuit includes a clocked inverter 1562 which inverts a given input signal when a control signal is at a high level, an inverter 1567 which inverts a given input signal when a control signal R is active, a clocked inverter 1566 which inverts an inverted signal output from the inverter 1567 when a control signal is at a high level, and an inverter 1568 which inverts a given input signal when a control signal L is active. The clocked inverters 1562 and 1566 and the inverters 1567 and 1568 are formed of combinations of p-channel and n-channel TFTs.

The control signal R becomes active when the transfer start pulse DX(R) is transferred in an R direction. On the other hand, the control signal L becomes active when the transfer start pulse DX(L) is transferred in the L direction. That is, the control signals L and R become active in an exclusive fashion. The signals C2, C4, . . . , Cn−3, Cn−1 level-shifted by the level shifters 1510 are supplied to the clocked inverters 1566 of the unit circuits at the even-numbered stages as seen from left to right and also to the clocked inverters 1562 of the unit circuits at the odd-numbered stages as seen from left to right. The signals C1, C3, . . . , Cn−2, Cn level-shifted by the level shifters 1520 are supplied to the clocked inverters 1562 of the unit circuits at the odd-numbered stages as seen from left to right and also to the clocked inverters 1566 of the unit circuits at the even-numbered stages as seen from left to right. That is, as in the first embodiment, the control signals applied to the clocked inverters 1562 and 1566 of the unit circuits at the even-numbered stages are opposite to the control signals applied to the clocked inverters 1562 and 1566 of the unit circuits at the odd-numbered stages. However, the signal C0 is a control signal applied only to the clocked inverter 1562 of the unit circuit at the first stage as seen from left, and the signal Cn+1 is a control signal applied only to the clocked inverter 1566 of the unit circuit at the first stage seen from right.

In the circuit configuration described above, when the transfer start pulse DX(R) is transferred in the R direction, the output of each inverter 1567 is fed back to the input of the corresponding clocked inverter 1566, and the output of each clocked inverter 1566 is fed back to the input of the corresponding inverter 1567. In this case, the output signals of the respective inverters 1567 are output as S1', S2', . . . , Sn−1', Sn' from the shift register circuit 1570. On the other hand, when the transfer start pulse DX(L) is transferred in the L direction, the output of each inverter 1568 is fed back to the input of the corresponding clocked inverter 1562, and the output of each clocked inverter 1562 is fed back to the input of the corresponding inverter 1568. In this case, the output signals of the respective inverters 1568 are output as Sn', Sn−1', . . . , S2', S1' from the shift register circuit 1570.

Referring again to FIG. 9, in the data line driving circuit 152 of the present embodiment, the number of stages of the shirt register 1570 and the number of shifter registers are greater by one than those of the data line driving circuit 150 according to the first embodiment. Therefore, latch circuits 1530 are disposed for the respective level shifters 1510 and 1520 which output the signals C1 to Cn−2.

On the other hand, latch circuits 1540 are disposed for the respective level shifters 1510 and 1520 which output the signals Cn to C3 as seen from right to left.

When the transfer start pulse DX(L) is transferred in the L direction, the set input terminal S of a latch circuit 1540 for outputting an enable signal to a certain level shifter is supplied with a signal output from a level shifter located immediately before (on the right side of) the certain level shifter, and the reset input terminal R of that latch circuit 1540 is supplied with a signal output from a level shifter located three stages behind (at the left side of) the certain level shifter. Therefore, when the transfer start pulse DX(L) is transferred in the L direction, a certain level shifter becomes enabled when a signal with the large logic swing is output from the level shifter located immediately before the certain level shifter and disabled when a signal with the large logic swing is output from the level shifter located three stages behind the certain level shifter.

However, when the transfer start pulse DX(L) is transferred in the L direction, the latch circuit 1540, which supplies the enable signal En to the level shifter 1520 which outputs the signal Cn, is set by the transfer start pulse DX(L) itself. Furthermore, when the transfer start pulse DX(L) is transferred in the L direction, because there is no level shifter located immediately ahead of (at the right side of) the level shifter 1510 which outputs the signal Cn+1, and because there are no level shifters located three stages behind (at the left sides of) the level shifters 1510 and 1520, respectively, which output the signals C2, C1, and C0, there are no corresponding latch circuits 1540 for these level shifters.

Furthermore, in the present embodiment, the enable signal applied to each level shifter 1510 or 1520 is given by the output of the OR circuit 1556, that is, given as the logical OR between the outputs of the AND circuits 1552 and 1554. One of the inputs of the AND circuit 1552 is supplied with the output signal of the latch circuit 1530, and the other input of the AND circuit 1552 is supplied with the control signal R. On the other hand, one of the inputs of the AND circuit 1554 is supplied with the output signal of the latch circuit 1540, and the other input is supplied with the control signal L.

Therefore, when the transfer start pulse DX(R) is transferred in the R direction, the AND circuits 1552 is opened, and the AND circuit 1554 is closed, and thus the output signal of the latch circuit 1530 is output as an enable signal. On the other hand, when the transfer start pulse DX(L) is transferred in the L direction, the AND circuits 1552 is closed, and the AND circuit 1554 is opened, and thus the output signal of the latch circuit 1540 is output as an enable signal.

However, in the present embodiment, when the transfer start pulse DX(R) is transferred in the R direction, the level shifters having no corresponding latch circuit 1530 and the level shifters located at either end, that is, the level shifters 1510, 1520 which output the signals C0, Cn−1, Cn, and Cn+1, respectively, are always enabled to operate. Furthermore, in the present embodiment, when the transfer start pulse DX(L) is transferred in the L direction, the level shifters having no corresponding latch circuit 1540 and the level shifters located at either end, that is, the level shifters which output the signals Cn+1, C2, C1, and C0, respectively, are always enabled to operate.

Operation of the Second Embodiment

The operation of the data line driving circuit 152 constructed in the above-described manner is described below. First, the operation of sequentially transferring the transfer start pulse DX(R) in the R direction and outputting signals S1', S2', . . . , Sn−1', Sn' one after another is described with reference to FIG. 9. In this case, the control signal R is made active so that the inverters 1556 of the unit circuits at the respective stages of the shift register circuit 1570 are enabled and the inverters 1568 are disabled. The enable signals E1 to En−2 are given as the outputs of the latch circuit 1530, whereas the enable signals E−1 and En are always maintained in an active state.

Figure 11:
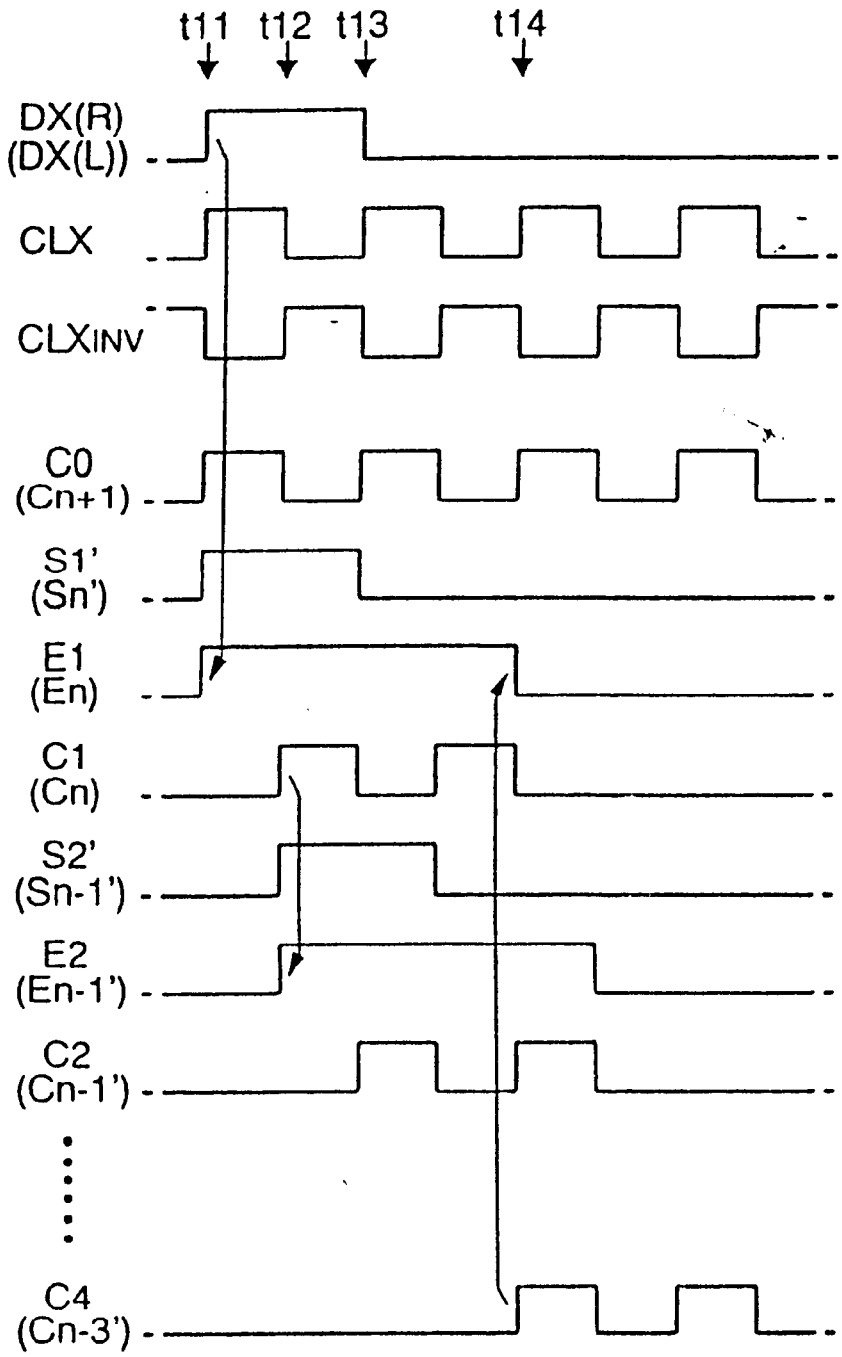
FIG. 11 is a timing chart illustrating the operation of the data line driving circuit shown in FIG. 9.

In this case, the circuit becomes equivalent to that of the first embodiment, and thus it operates in absolutely the same manner, as shown in FIG. 11. That is, the transfer start pulse DX(R) is sequentially shifted every one-half period of the clock signal CLX and the inverted clock signal $CLX_{INV}$ both having the small logic swing and output as output signals S1'–Sn' from the respective stages of the shift register circuit 1570.

The operation of sequentially transferring the transfer start pulse DX(L) in the L direction and outputting signals Sn', Sn−1', . . . , S2', S1' one after another is now described below. In this case, the control signal L is made active so that the inverters 1557 of the unit circuits at the respective stages of the shift register circuit 1570 are enabled and the inverters 1567 are disabled. The enable signals En to En3, seen from the L direction, are given as the outputs of the latch circuit 1540, whereas the enable signals E2 and E1 are always maintained in an active state.

In this case, the circuit has a configuration which is obtained by inverting, in a horizontal direction as obtained when reflected by a mirror, the configuration used to transfer the transfer start pulse DX(R) in the R direction. Therefore, the transfer operation is performed in the same manner (as represented within parentheses in FIG. 11). That is, the transfer start pulse DX(L) is sequentially shifted every one-half period of the clock signal CLX and the inverted clock signal $CLX_{INV}$ both having the small logic swing, and output as output signals Sn'–S1' from the respective stages of the shift register circuit 1570.

In the data line driving circuit 152 described above, the power consumption can be reduced to an extremely low level for the same reason as in the first embodiment. Furthermore, the signals can be output in the order S1', S2', . . . , Sn−1', Sn' by transferring the transfer start pulse DX(R) in the R direction, whereas the signals can be output in the order Sn', Sn−1, . . . , S2', S1' by transferring the transfer start pulse DX(L) in the L direction.

On the other hand, the scanning line driving circuit according to the second embodiment has a configuration similar to that of the data line driving circuit 152 shown in FIG. 9 except that different input signals are given. That is, in FIG. 9, the transfer start pulse DX(R) or DX(L) supplied at the start of each horizontal scanning period is replaced with a transfer start pulse DY(U) or DY(D) supplied, depending on whether the scanning is performed from top to down or from bottom to top, at the start of each vertical scanning period, and the clock signal CLX and the inverted clock signal $CLX_{INV}$ are replaced with a clock signal CLY and an inverted clock signal $CLY_{INV}$, respectively, with the small logic swing.

Using this scanning line driving circuit, the scanning lines 112 can be sequentially selected from top to down by transferring the transfer start pulse DY(D) from top to down, whereas the scanning lines 112 can be sequentially selected from bottom to top by transferring the transfer start pulse DY(U) from bottom to top.

Thus, using the driving circuits according to the second embodiment, an image inverted right to left can be displayed by transferring, in a direction from right to left, the transfer start pulse DX(L) input to the data line driving circuit 152 at the start of each horizontal scanning period. On the other hand, if the transfer start pulse DY(U) input to the scanning line driving circuit at the start of each vertical scanning period is transferred from top to bottom, and if the transfer start pulse DX(L) input to the data line scanning circuit 152 at the start of each horizontal scanning period is transferred from right to left, an image is displayed in a vertically and horizontally inverted fashion. This technique is especially useful when the liquid crystal display panel 100 is rotatable about the X axis.

In the present embodiment described above, when the transfer start pulse DX(R) is transferred in the R direction, the level shifters 1510 and 1520 serving to output the signals Cn−1, Cn, and Cn+1, respectively, are maintained in the enabled state, whereas the level shifters 1510 and 1520 serving to output the signals C2, C1, and C0, respectively, are maintained in the enabled state when the transfer start pulse DX(L) is transferred in the L direction. Alternatively, there may be provided latch circuits corresponding to these level shifters in a similar manner for the other level shifters so as to enable these level shifters only within limited periods.

In this case, the set input terminal S of each of these latch circuits is coupled with the output of the level shifter located immediately before the level shifter corresponding to the latch, as in the other latch circuits. However, there is no level shifter located three stages behind the level shifter corresponding to the latch. Thus, when the transfer is performed in the R direction, the signals C1, C2, and C3, the transfer start pulse DX, and the precharge driving signal NRG are applied, whereas the signals Cn−1, Cn, and Cn+1, the transfer start pulse DX, and the precharge driving signal NRG are applied, when the transfer is performed in the L direction. In this configuration, the level shifters are disabled during a period from the reset time to the set time when the next scanning line is selected, and thus electric power consumption further decreases.

In the above-described data line driving circuit 152 according to the second embodiment, the level shifters 1510 and 1520 are enabled by the latch circuits 1530 when the transfer start pulse DX(R) is transferred in the R direction, whereas they are enabled by the latch circuits 1540 when the transfer start pulse DX(L) is transferred in the L direction, Thus, to enable one level shifter, it is required to provide two latch circuits, one AND circuit (NAND circuit in the case of the negative logic), and two OR circuits (NOR circuits in the case of the negative logic). If these circuit elements are formed on a single substrate using TFTs, 20 TFTs are required at least.

When the shift register circuit includes a large number of stages, a correspondingly large number of level shifters are required, and the number of elements required to enable one level shifter increases. This results in an increase in the circuit area and a reduction in the production yield. Thus, the present invention provides a third embodiment of a driving circuit which needs a smaller number of circuit elements for enabling one level shifter.

Figure 12:
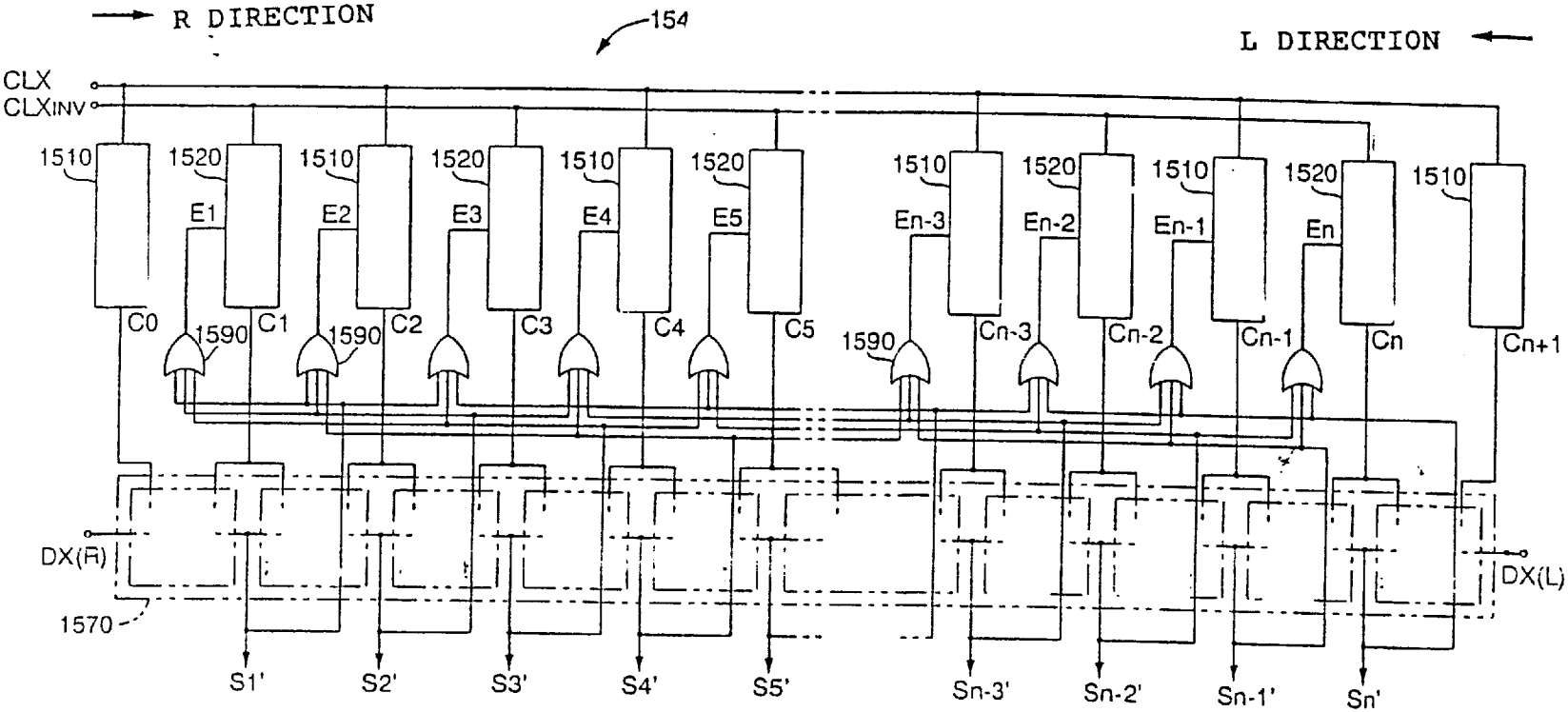
FIG. 12 is a block diagram illustrating a data line driving circuit which is one of driving circuits according to a third embodiment of the invention.

In this third embodiment, the data line driving circuit 152 shown in FIG. 9 is replaced with a data line driving circuit 154 shown in FIG. 12. In FIG. 12, similar parts to those in FIG. 4 or 9 are denoted by similar reference numerals, and they are not described in further detail.

In the data line driving circuit 154 of the present embodiment, as shown in FIG. 12, enable signals E1–En are output in a simplified fashion from OR circuits 1590 and applied to the level shifters 1510 and 1520 for outputting the signals C1–Cn, wherein each OR circuit 1590 outputs the logical OR of proper combinations of output signals S1'–Sn' of the shift register circuit 1570.

Of the enable signals output from the respective OR circuits 1590,1 the enable signals E3 to En−2 are output as the logical OR of the signals Sm−2, Sm, and Sm+1 (m=3, 4, . . . , n−3, n−2) output from the shift register 1570. More specifically, the enable signal E1 is output as the logical OR of the output signals S1', S2', and S3', the enable signal E2 is output as the logical OR of the output signals S1', S2', and S4', the enable signal En−1 is output as the logical OR of the output signals Sn−3 ', Sn−1', and Sn', and the enable signal En−1 is output as the logical OR of the output signals Sn−2', Sn−1', and Sn'.

Figure 13:
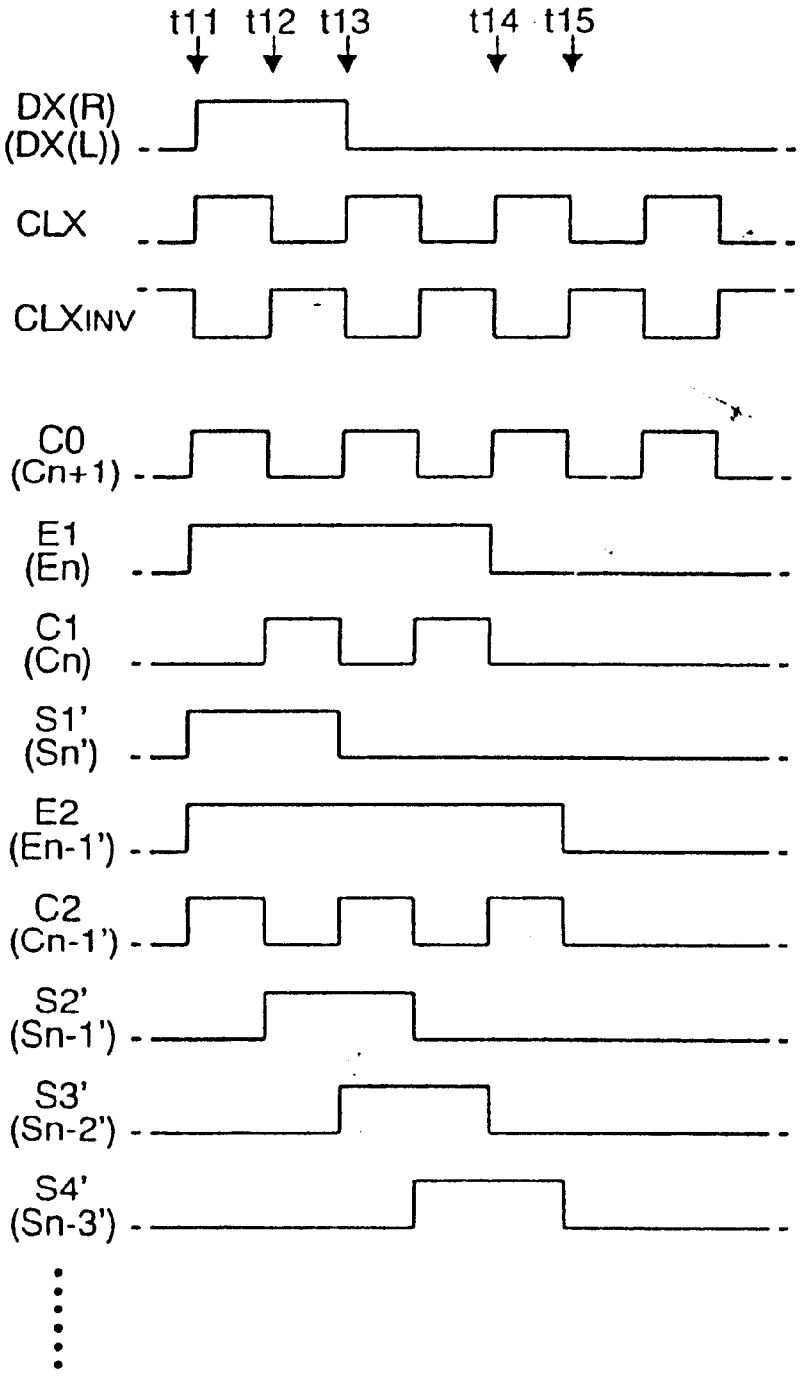
FIG. 13 is a timing chart illustrating the operation of the data line driving circuit shown in FIG. 12.

Referring to the timing chart shown in FIG. 13, the operation of the data line driving circuit 154 constructed in the above-described manner is described below.

First, the operation of transferring the transfer start pulse DX(R) in the R direction is described. When a transfer start pulse DX(R) is input at time t11, if the clock signal CLX with the small logic swing rises up (the inverted clock signal $CLX_{INV}$ with the small logic swing fall down), the signal C0 with the same phase as that of clock signal CLX also rises up. As a result, the clocked inverter 1562 of the unit circuit at the first stage inverts the high-level transfer start pulse DX(R), and the clocked inverter 1567 of the unit circuit at the first stage inverts the output of the above clocked inverter 1562. As a result, the output signal S1' of the unit circuit at the first stage becomes high, and the enable signals E1, E2, and E3 (not shown) also become high.

If the clock signal CLX with the small logic swing falls down at time t12 during the period in which the transfer start pulse DX is applied, there is nothing which determines the level of the signal S1', and thus the signal S1' is maintained at the immediately previous level, that is, the high level. As a result, the enable signal E1 is also maintained at the high level, and the signal C1 output from the level shifter 1520 enabled by this enable signal E1 rises up to the high level in the same phase as the inverted clock signal $CLX_{INV}$. Thus, in response to the signal C1 rising up to the high level, the clocked inverter 1566 of the unit circuit at the first stage inverts the output signal S1' at the high level and feeds the resultant signal back to the inverter 1567. As a result, the output signal S1' is maintained at the high level.

On the other hand, in response to the signal C1 rising up to the high level, the clocked inverter 1562 of the unit circuit at the second stage inverts the high-level signal S1' output from the unit circuit at the first stage, and the clocked inverter 1567 of the unit circuit at the second stage inverts the output signal of the clocked inverter 1562. As a result, the output signal S2' of the unit circuit at the second stage becomes high, and the enable signal E4 (not shown) also becomes high.

After that, if the transfer start pulse DX falls down at time t13, and if the clock signal CLX with the small logic swing rises up again (the inverted clock signal $CLX_{INV}$ with the small logic swing falls down), the low-level of the transfer start pulse DX is input into the clocked inverter 1562 of the unit circuit at the first stage, and the output signal S1' of that unit circuit becomes low. On the other hand, in response to the signal C2 rising up to the high level, the clocked inverter 1566 of the unit circuit at the second stage feeds the inverted signal of the output signal S2' maintained by capacitance at the high level back to the inverter 1567. As a result, the output signal S2' is maintained at the high level. On the other hand, in response to the signal C2 rising up to the high level, the clocked inverter 1562 of the unit circuit at the third stage inverts the high-level signal S2' output from the unit circuit at the second stage, and the inverter 1567 of the unit circuit at the second stage inverts the output of the clocked inverter 1562. As a result, the output signal S3' of the unit circuit at the third stage becomes high.

The operation is continued in a similar manner, the initially-input transfer start pulse DX is sequentially shifted every one-half period of the clock signal CLX and the inverted clock signal $CLX_{INV}$ both having the small logic swing and output as output signals S1'–Sn' from the respective stages of the shift register circuit 1570.

The enable signal E1 becomes low when the output signal S3' falls down to the low level at time t14. Therefore, the level shifter 1520 serving to output the signal C1 is enabled only during the period from time t11 to time t14. On the other hand, the enable signal E2 becomes low when the output signal S4' falls down to the low level at time t15. Therefore, the level shifter 1510 serving to output the signal C2 is enabled only during the period from time t11 to time t15.

Similarly, the level shifter serving to output the signal Cm (m=3, 4, . . . , n−3, n−2) is enabled only during the period in which the output signals Sm−2, Sm, and Sm+2 are at the high level, and the level shifter 1510 serving to output the signal Cn−1 is enabled only during the period in which the output signals Sn−3, Sn−1, and Sn are at the high level. The level shifter 1520 serving to output the signal Cn is enabled only during the period in which the output signals Sn−2, Sn−1, and Sn are at the high level.

The operation of transferring the transfer start pulse DX(L) in the L direction is described next. Like the data line driving circuit 152 shown in FIG. 9, the data line driving circuit 154 shown in FIG. 12 is also symmetric in a right to left direction. Therefore, the transfer operation in the L direction is performed in the same manner as in the transfer operation in the R direction (as represented within parentheses in FIG. 13).

In this data line driving circuit 154, as in the data line driving circuit 150 according to the first embodiment, the power consumption can be reduced to an extremely low level. Furthermore, as in the data line scanning circuit 152 according to the second embodiment, it is possible to transfer the transfer start pulse in both directions. Besides, because the enable signals supplied to the respective level shifters 1510 and 1520 are output via OR circuits 1590, the circuit area of the data line driving circuit 154 can be greatly reduced. That is, in the present embodiment, the circuit element required to enable one level shifter is only one 3-input OR circuit 1590 which may be formed on a single substrate using as small a number of TFTs as eight TFTs. The number of TFTs required to enable one level shifter is smaller by 12 than required in the second embodiment.

Other Examples of Level Shifters

Figure 14:
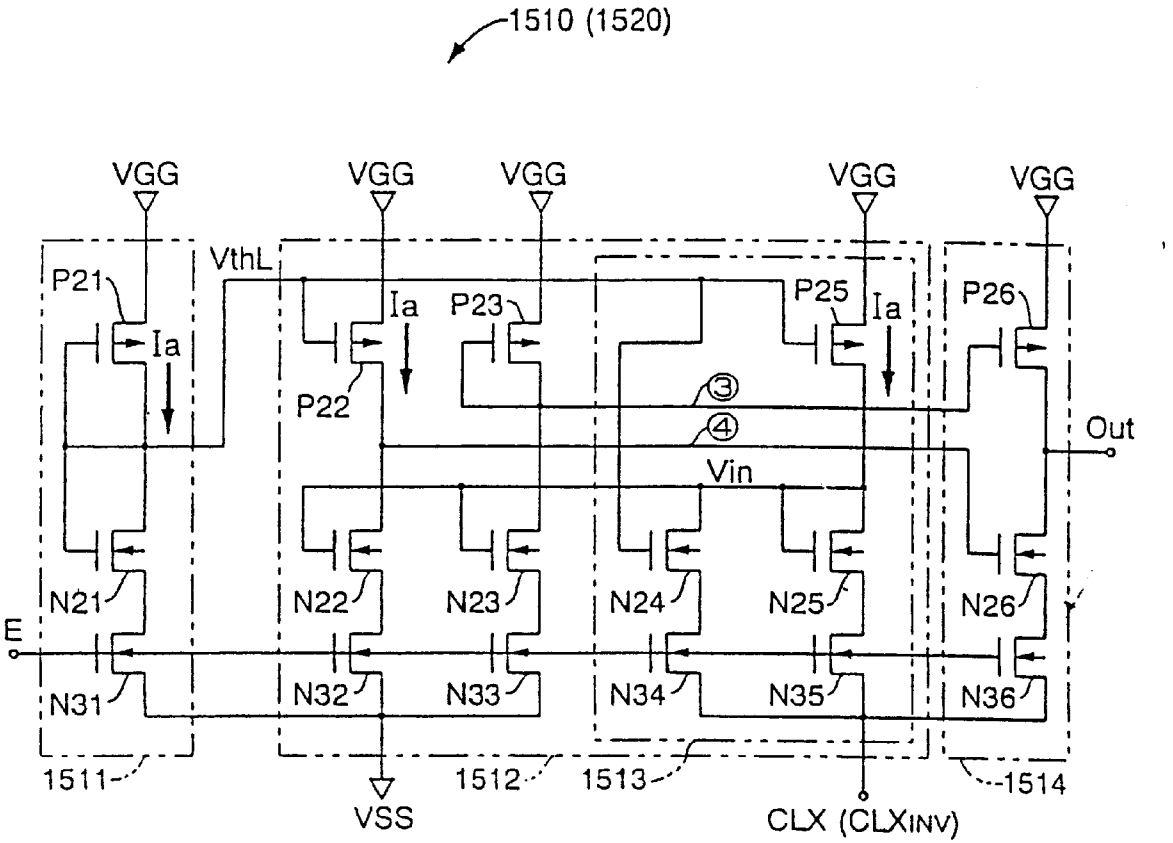
FIG. 14 is a circuit diagram illustrating another example of the circuit configuration of the level shifter applicable to the driving circuit according to the present invention.

The circuit configuration of the level shifters 1510 (1520) applicable to the data line driving circuit according to the first, second or third embodiment is not limited to that shown in FIG. 5, and various types of circuit configurations are possible. One example is shown in FIG. 14. That is, FIG. 14 illustrates another example of the circuit configuration of the level shifters 1510 for converting the clock signal with the small logic swing to a signal with the large logic swing. The level shifters 1520 for converting the inverted clock signal $CLX_{INV}$ may also be constructed in a similar configuration except that the inverted clock signal $CLX_{INV}$ is input instead of the clock signal CLX. The level shifter 1510 shown in FIG. 14 includes a threshold generator 1511, an amplifier 1512, and an output circuit 1514. The threshold generator 1511 includes a p-channel transistor P21 and an n-channel transistor N21 which are formed in substantially the same manner as the output circuit 1514 and which are connected in series in the form of a diode-connection such that a threshold voltage VthL for the output circuit 1514 is generated at the common drain. The source of the transistor N21 is connected to the low-level voltage VSS of the large logic swing via an n-channel transistor N31 which is turned on and off by an enable signal applied to the terminal E. That is, when the enable signal applied to the terminal E is at the low level, the generation of the threshold voltage VthL is disabled.

The amplifier 1512 includes a p-channel transistor P22 which forms, together with the threshold generator 1511, a current mirror circuit and which provides a mirror current, an n-channel transistor N22 for controlling the mirror current in accordance with a signal Vin to be amplified, an n-channel transistor N23 for controlling the current flowing through a current source transistor P23 in accordance with the signal Vin to be amplified, an n-channel transistor N32 disposed between the source of the transistor N22 and the low-level voltage VSS of the large logic swing, and an n-channel transistor N33 disposed between the source of the transistor N23 and the low-level voltage VSS of the large logic swing. Herein, for convenience of illustration, the signal line connected to the drain of the transistor N23 (P23) is denoted by (3), and the signal line connected to the drain of the transistor N22 (P22) is denoted by (4).

The amplifier 1512 also includes a threshold shifting circuit 1513. The threshold shifting circuit 1513 adds or subtracts an offset voltage to or from a clock signal CLX input via an n-channel transistor N35 in accordance with the level of the clock signal CLX and outputs the resultant voltage as the signal Vin to be amplified. The threshold shifting circuit 1513 includes: a p-channel transistor P25 which forms, together with the threshold generator 1511, a current mirror circuit and which serves to provide a mirror current, an n-channel transistor N25 which is connected in series to the p-channel transistor 25 so as to serve as a diode and which is provided, at its source, with the clock signal CLX via an n-channel transistor N35 and also provided, at its drain, with the signal Vin to be amplified, and an n-channel transistor N24 which serves to set a DC bias and which is provided, at it source, with the clock signal CLX via an n-channel transistor N34 and also provided, at its circuit, with the threshold voltage VthL.

The output circuit 1514 includes a p-channel transistor P26 and an n-channel transistor N26 wherein the source of the p-channel transistor P26 is connected to the high-level voltage VGG of the large logic swing, the drain thereof is connected to the output terminal OUT, and the circuit thereof is connected to the signal line (3), and wherein the source of the n-channel transistor N26 is connected to the input terminal via which the clock signal CLX is input, the drain thereof is connected to the output terminal OUT, and the circuit thereof is connected to the signal line (4).

Now, the operation of the level shifter 1510 (1520) shown in FIG. 14 is described. First, the operation is described for the case where the enable signal is at the high level. In this case, a feed-through current Ia flows through the threshold generator 1511. Herein, if the transistors of the level shifter 1510 are formed such that they become substantially identical, a mirror current equal to the feed-through current Ia flows through the transistor P25. Because the threshold voltage VthL is also applied to the transistor N24, the on-resistance of the transistor N24 is given approximately by VthL/Ia. Therefore, if the transistor N25 is assumed to be in an absolutely turned-off state, the signal Vin to be amplified becomes equal to VthL.

However, because the transistor N25 functions as a diode which is always in a saturated state, a current flows through the transistor N25 although it is small. Herein, it the clock signal CLX is at the low level, a greater current flows through the transistor N25 than flows when the clock signal CLX is at the high level, and a smaller current flows through the transistor N24. As a result, the signal Vin to be amplified becomes smaller than the threshold voltage VthL by a magnitude equal to the product of the current flowing through the transistor N25 and the on-resistance of the transistor N25.

When the clock signal CLX is at the high level, the current flowing through the transistor N24 becomes smaller than flows when the clock signal CLX is at the low level. However, because the source voltage of the transistor N24 is increased by the increase of the clock signal CLX to the high level, the signal Vin to be amplified becomes equal to the threshold voltage VthL minus the product of the current flowing through the transistor N25 and the on-resistance of the transistor N25 plus the high-level voltage of the small logic swing corresponding to the high-level of the clock signal CLX. As a result, the signal Vin to be amplified becomes higher than the threshold voltage VthL provided that the voltage corresponding to the high-level of the clock signal CLX with the small logic swing is greater than the product of the on-resistance of the transistor N25 and the current which flows through the transistor N25 when the clock signal CLX is at the high level. That is, as far as the above condition is satisfied, the signal Vin to be amplified becomes high than the threshold voltage VthL when the clock signal CLX is at the high level and becomes lower than the threshold voltage VthL when the clock signal CLX is at the low level. Herein, the current flowing through the transistor N25 is smaller when the clock signal CLX is at the high level than at the low level, and the low on-resistance of the transistors can be easily realized using the semiconductor processing technology, the above-described condition can be satisfied with no difficulty.

If the clock signal CLX becomes high, and if, as a result, the signal Vin to be amplified becomes higher than the threshold voltage VthL, then the source current flowing through the transistor N23 abruptly increases, and the drain voltage of the transistor N23 abruptly decreases. As a result, the voltage on the signal line (3) is substantially pulled down to the low-level voltage VSS of the large logic swing. The mirror current flowing through the transistor N22 also abruptly increases, and the drain voltage of the transistor N22 abruptly decreases. As a result, the voltage on the signal line (4) is substantially pulled down to the low-level voltage VSS of the large logic swing. Therefore, in the output circuit 1514, the transistor N26 is turned off, and the transistor P26 is turned on. As a result, the voltage of the output terminal OUT becomes equal to the high-level voltage VGG of the large logic swing.

Conversely, if the clock signal CLX becomes low, and if, as a result, the signal Vin to be amplified becomes lower than the threshold voltage VthL, then the source current flowing through the transistor N23 abruptly decreases, and the drain voltage of the transistor N23 abruptly increases. As a result, the voltage on the signal line (3) is substantially pulled up to the high-level voltage VGG of the large logic swing. The mirror current flowing through the transistor N22 also abruptly decreases, and the drain voltage of the transistor N22 abruptly increases. As a result, the voltage on the signal line (4) is substantially pulled up to the high-level voltage VGG of the large logic swing. Therefore, in the output circuit 1514, the transistor N26 is turned on, and the transistor P26 is turned off. As a result, the voltage of the output terminal OUT becomes equal to the low-level voltage of the clock signal CLX with the low logic swing.

In the above operation, the signal lines (3) and (4) are not fully pulled down to the low-level voltage VSS of the large logic swing, and they are fully pulled up to the high-level voltage VGG of the large logic swing, because it is required that the mirror current equal to the feed-through current Ia should be always flowing in the amplifier 1512. However, this causes no problem, because the voltage of the output terminal OUT of the output circuit 1514 is swung to either the low-level voltage of the small logic swing or the high-level voltage VGG of the large logic swing.

In the level shifter 1510 (1520), because the signal Vin amplified by the amplifier 1512 becomes higher than the threshold voltage VthL when the clock signal CLX is at the high level and becomes lower than the threshold voltage VthL when the clock signal CLX is at the low level, the voltages on the signal lines (3) and (4) greatly swing about the threshold voltage VthL. Therefore, even if the clock signal CLX has distortion, the distortion is suppressed by the signal with the large logic swing.

On the other hand, when the enable signal is at the low level, the transistors N31–N36 are all turned off. As a result, the generation of the threshold voltage VthL by the threshold generator 1511, the flowing of the mirror current into various parts in the amplifier 1512, the inputting of the clock signal CLX with the small logic swing into the threshold shifting circuit 1513, and the operation of the output circuit 1514 are all disabled, and thus the power consumption of the level shifter 1510 (1520) is minimized.

Other Examples of Shift Register Circuit (Unit Circuit)

In the driving circuit according to the first embodiment, the shift register circuit 1560 is formed of a plurality of cascaded unit circuits each consisting of clocked inverters 1552 and 1556 and an inverter 1554, as shown in FIG. 7. However, the unit circuit is not limited to such a configuration. For example, each unit circuit may also be formed of, as described in FIG. 15A, two p-channel transistors P21 and P22 which are exclusively driven by the clock signal CLX and the inverted clock signal CLX,NV both having the large logic swing, an inverter 1581 for inverting the output of the transistor P41, an inverter 1582 for again inverting the output of the inverter 1581, a NAND circuit 1587 for outputting an inverted AND of the output of the transistor P22 and the output of the inverter 1582 in the following stage, and an inverter 1588 for inverting the output of the NAND circuit 1587 and outputting the resultant signal as the output signal of the unit circuit.

On the other hand, in the driving circuit according to the second embodiment, the shift register circuit 1570 is formed of, as shown in FIG. 10, a plurality of cascaded unit circuits each including clocked inverters 1552 and 1556 and inverters 1557 and 1558. However, each unit circuit is not limited to such a configuration. For example, each unit circuit may also be constructed in a configuration such as that shown in FIG. 15B which can be obtained by replacing the inverter 1582 in the circuit shown in FIG. 15A with an inverter 1583 which is enabled when the transfer start pulse DX(R) is transferred in the R direction and furthermore by providing an inverter 1584 which is enabled when the transfer start pulse is transferred in the L direction.

Figure 15A:
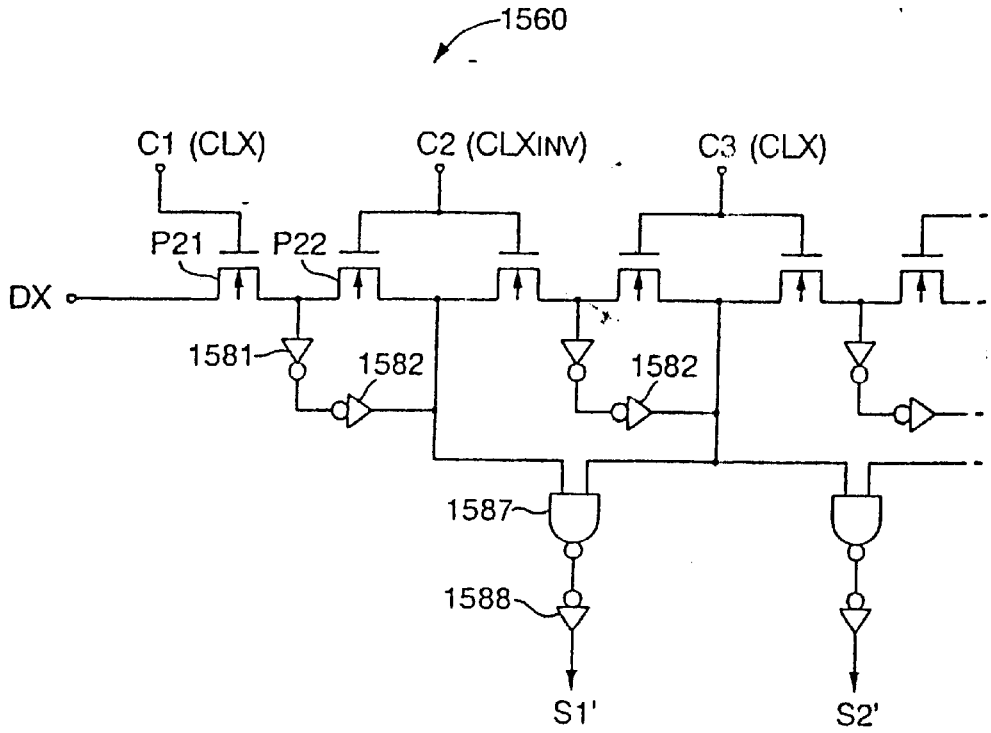
FIGS. 15A and 15B are circuit diagrams illustrating further examples of the circuit configuration of the shift register circuit applicable to the driving circuit according to the present invention.
Figure 15B:
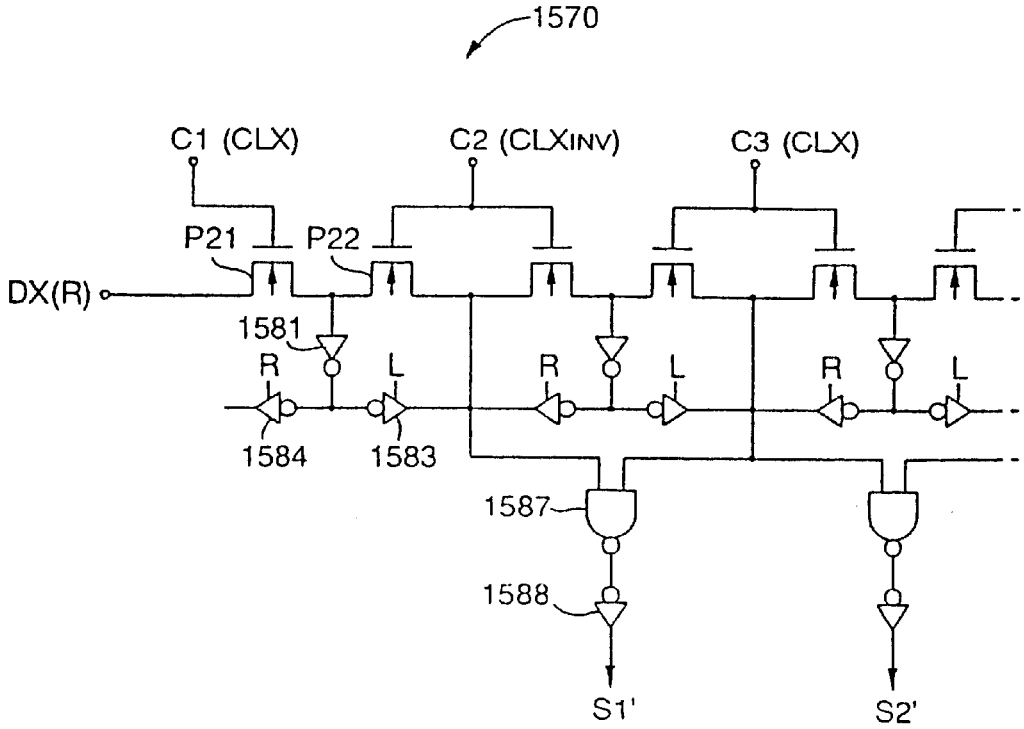

In addition to the configurations shown in FIGS. 15A and 15B, the unit circuit may also be constructed by properly combining a flip-flop, a latch, a capacitor, etc., and the shift register circuit may be constructed by connecting a plurality of these unit circuits in a cascade fashion. Shutting off the Clock Signal with the Small Logic Swing in Accordance with Enable Signals In the level shifter 1510 (1520) shown in FIG. 5, when the enable signal is at the low level, the transistor N11 is turned off, and thus the power supply voltage supplied as the high-level voltage VGG of the large logic swing is shut off. In the level shifter 1510 (1520) shown in FIG. 5, as described earlier, when no transition occurs in the voltage of the clock signal CLX ($CLX_{INV}$) with the small logic swing, the voltages on the signal lines (1) and (2) remain unchanged, and substantially no electric power is consumed. Therefore, the reduction in power consumption may also be achieved by shutting off the line for supplying the clock signal CLX ($CLX_{INV}$) with the small logic swing when the enable signal is at the low level, in a similar manner as described above with reference to FIG. 14.

When the enable signal is at the low level, the shutting off of the line serving to supply the clock signal CLX ($CLX_{INV}$) to the level shifter 1510 (1520) may be performed not by a simple transistor but by a transmission circuit. This allows a reduction in the capacitance associated with the line for supplying the clock signal CLX ($CLX_{INV}$) with the small logic swing and thus a reduction in power consumption due to the capacitance.

When the line for supplying the clock signal CLX ($CLX_{INV}$) to a certain level shifter is shut off, if the line for transmitting the output signal of the unit circuit corresponding to that level shifter is also shut off, the power consumption due to the capacitance associated with that line can be reduced.

Relationship between the Stages of the Shirt Register and the Level Shifters In the first, second, and third embodiments described above, the level shifters 1510 and 1520 are provided such that one level shifter is coupled with unit circuits at two adjacent stages of the shift register circuit. This is because the transfer start pulse DX is transferred in synchronization with the two-phase clock signal consisting of the clock signal CLX and the inverted clock signal $CLX_{INV}$. If the transfer start pulse DX is transferred in synchronization with a single-phase clock signal, level shifters may be provided such that one level shifter is coupled with a unit circuit at one stage or unit circuits at a plurality of stages.

Figure 16:
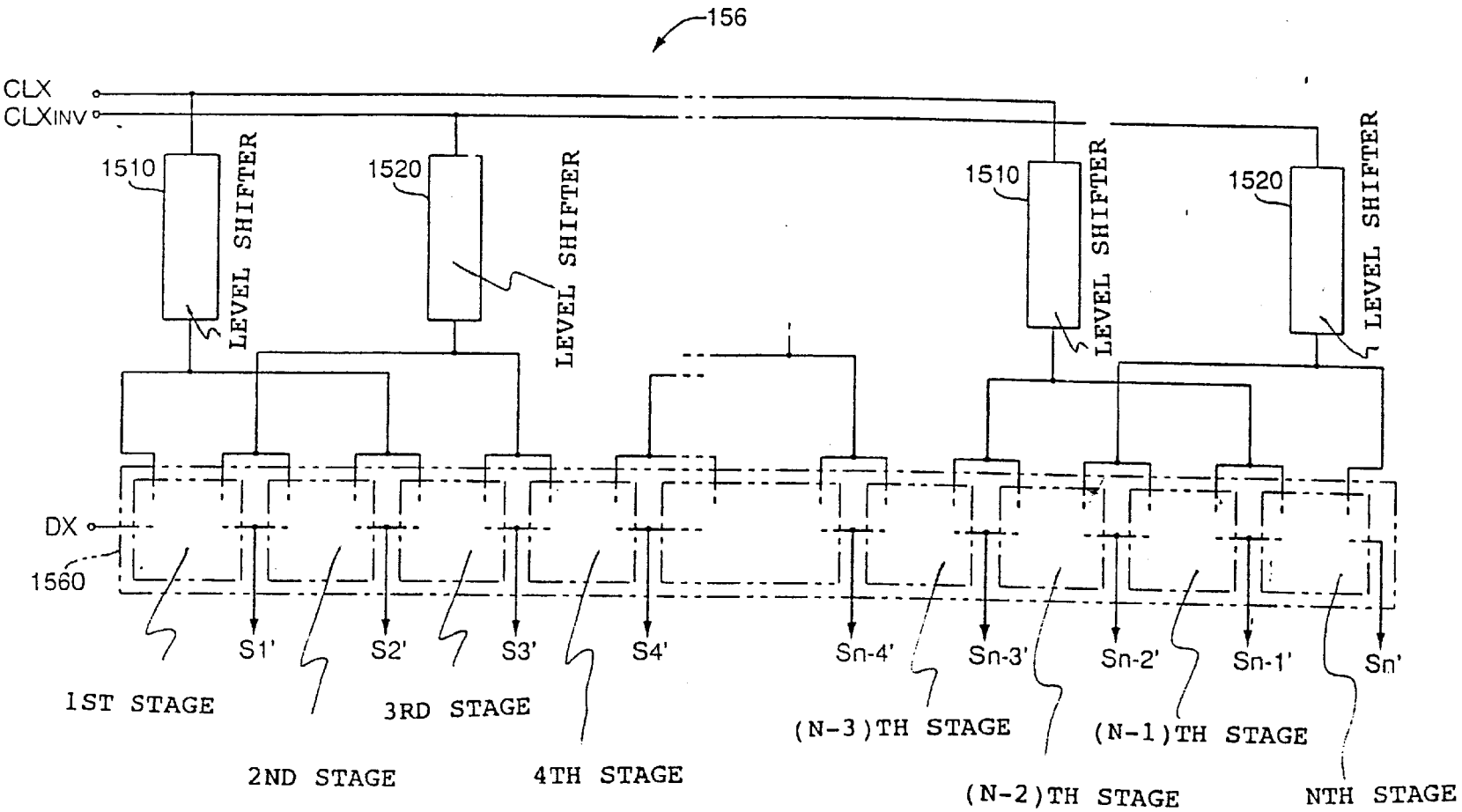
FIG. 16 is a block diagram partially illustrating a modification of the driving circuit according to the present invention.

In the present invention, it is not necessarily required that one level shifter be coupled with a unit circuit at one stage of the shift register circuit. For example, as shown in FIG. 16, even when a two-phase clock signal is employed, level shifters 1510 and 1520 may be provided such that one level shifter is coupled with unit circuits at a plurality of stages.

In the case where level shifters 1510 and 1520 are provided such that one level shifter is coupled with unit circuits at a plurality of stages, it is required to supply enable signals to the level shifters 1510 and 1520 such that an enable signal to a certain level shifter rises up to the high level to enable the certain level shifter immediately before or at the same time as the rising-up transition of the output signals of unit circuits at a plurality of stages coupled with the certain level shifter via which a level-shifted clock signal CLX ($CLX_{INV}$) with the large logic swing is supplied, and such that the enable signal fall down to the low level to disable the certain level shifter immediately after or at the same time as the falling-down transition of the output signals of unit circuits at the plurality of stages. Such a requirement may be satisfied if the enable signal to a certain level shifter is given, as described earlier with reference to the third embodiment, by the logical OR of the output signal of the unit circuit located one stage ahead of the first unit circuit coupled with the certain level shifter, the output signals of the unit circuits at the stages coupled with the certain level shifter, and the output signal of the unit circuit located one stage behind the last unit circuit coupled with the certain level shifter.

Operation Timing of the Level Shifter

In the case where one level shifter is coupled with a unit circuit at one stage or unit circuits at a plurality of stages of the shift register circuit, the enable signal supplied to a level shifter is not necessarily required to be given as the logical OR of the output signals of the unit circuit located one stage ahead of the first unit circuit coupled with the certain level shifter, the output signals of the unit circuits at the stages coupled with the certain level shifter, and the output signal of the unit circuit located one stage behind the last unit circuit coupled with the certain level shifter. Instead, the output signals of unit circuits two or more stages ahead and behind may also be employed so that the enable signal rises up to the high level with sufficient lead time. This is useful when the operation of the level shifter has a rather large delay. However, if the enable signal is raised up to the high level with early timing in a very redundant fashion, unnecessary power is consumed by the respective level shifters.

Number of Expanded Phases and Number of Data Lines per Group

In the above description, the sampling circuit 140 samples image signals VID1–VID6 expanded into six phases at the same time and supplies the resultant sampled image signals over six data lines 114 belonging to one group such that image signals VID1–VID6 are applied to data lines group by group. However, the number of expanded phases and the number of data lines to which image signals are applied at a time (that is, the number of data lines belonging to one group) are not limited to 6. For example, if the sampling switches 141 of the sampling circuit 150 can respond at a high speed, the image signal may be transmitted in a serial fashion via one signal line and may be sequentially sampled for each of data lines 114. On the other hand, the number of expanded phases and the number of data lines to which the image signals are applied at the same time may be set to 3, 12, or 24. That is, 3-, 12-, or 24-expanded phase image signals may be simultaneously supplied to 3, 12, or 24 data lines. Because a color image signal includes three components pertaining to three primary colors, it is desirable that the number of expanded phases and the number of data lines to which image signals are applied at a time be an integral multiple of 3 thereby making it possible to perform the operation in a simple fashion with a circuit with a simple configuration,

Construction of the Device Substrate

In the embodiments described above, the device substrate 101 of the liquid crystal display panel 100 is assumed to be formed of a transparent insulating material such as glass. Furthermore, the switching elements 116 of the respective pixels and the driving circuits 120 are assumed to be formed of TFTs wherein the sources, the drains, and the channels of the respective TFTs are formed in a thin silicon film formed on the substrate. However, the present invention is not limited to such a construction.

For example, the device substrate 101 may also be formed of a semiconductor substrate, and the switching elements 116 of the respective pixels and the driving circuits 120 may be formed of insulating circuit field effect transistors whose source, drain and channel are formed on the surface of the semiconductor substrate. In this case, the pixel electrodes 118 may be formed of metal such as aluminum serving as a reflecting electrode, or may be formed of into a multilayer structure consisting of a plurality of dielectric films so as to serve as a reflecting layer. When the device substrate 101 is formed of a transparent substrate, the pixel electrodes may also be constructed in a reflective form.

Furthermore, although in the above description, the switching elements 116 of the respective pixels are realized with transistors acting as three-terminal devices, the switching element 116 of each pixel may also be realized using a two-terminal device such as a diode. In this case, either the scanning lines 112 or the data lines 114 are formed in the shape of stripes on the opposite substrate 102 such that they oppose the respective pixel electrodes via the liquid crystal layer.

Electronic Devices

Some examples of electronic devices using the liquid crystal display panel 100 are described below.

1. Projector

Figure 17:
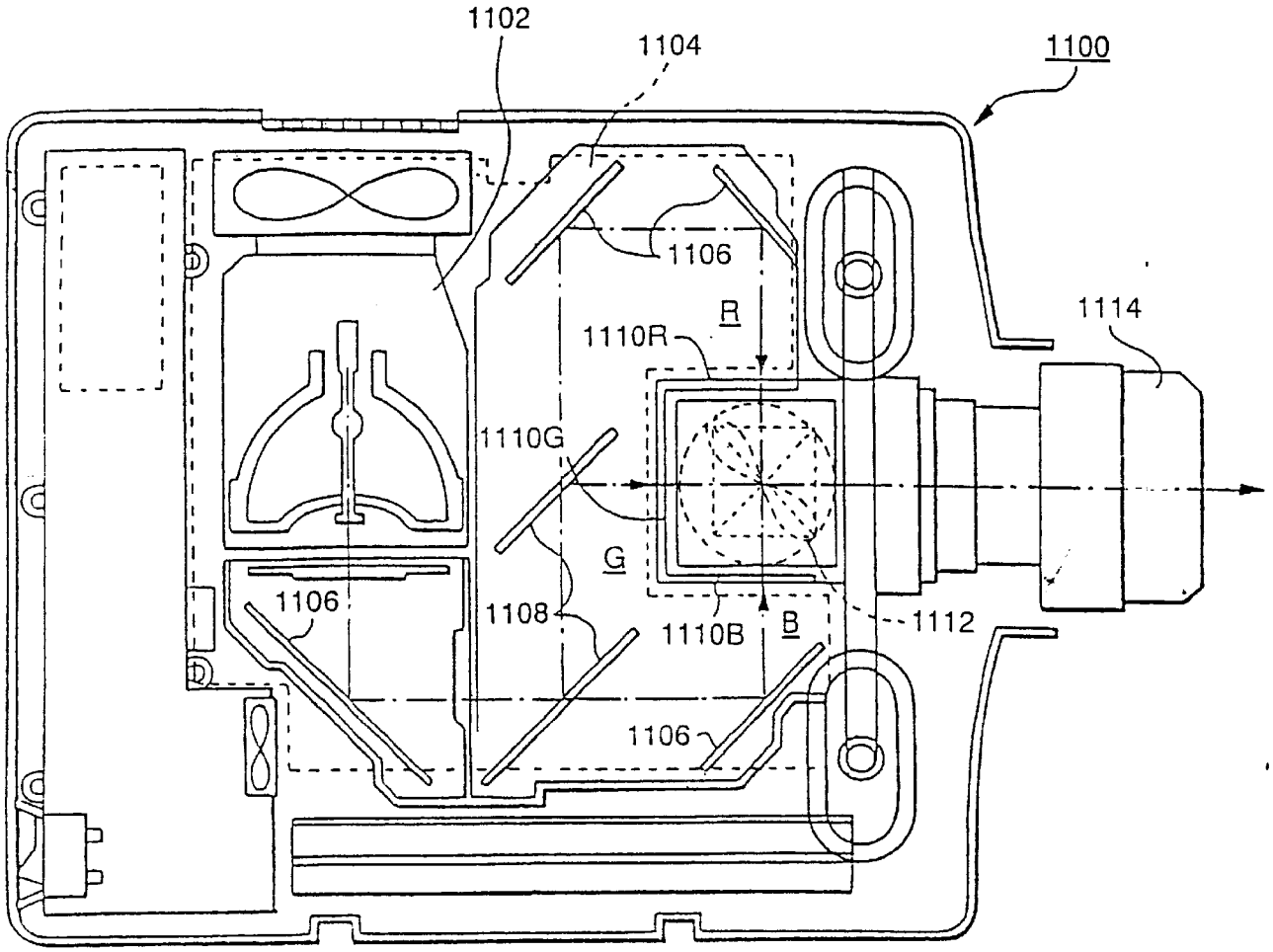
FIG. 17 is a cross-sectional view illustrating a liquid crystal projector as an example of an electronic apparatus using a liquid crystal display device according to the present invention.

As a first example, a projector using the liquid crystal display panels as light valves is described. FIG. 17 is a plan view illustrating an example of the structure of the projector.

As shown in FIG. 17, the projector 1100 includes a lamp unit 1102 including a white light source such as a halogen lamp. Projection light emitted from the lamp unit 1102 is divided, by four mirrors 1106 and two dichroic mirrors 1108 disposed in a light guide 1104, into three light rays with three primary colors RGB, which are incident on corresponding liquid crystal panels 1110R, 1110B, and 1110G serving as light valves for the respective primary colors.

The liquid crystal panels 1110R, 1110B, and 1110G are constructed in the same manner as the liquid crystal display panel 100, and they are driven by three primary color signals R, G, and B supplied from an image signal processing circuit (not shown). The light rays modulated via the liquid crystal panels are incident on a dichroic prism 1112 from three different directions. The light rays R and B are bent by 90° by the dichroic prism 1112, whereas the light ray G directly passes through the dichroic prism 1112. As a result, images with the respective colors are mixed into a single image via the dichroic prism 1112, and the resultant color image is projected onto a screen via a projection lens 1114.

In this projector, it is required that images be produced by the respective liquid crystal panels 1110R, 1110B, and 1110G such that the image produced by the liquid crystal panel 1110G is horizontally inverted with respect to the images produced by the liquid crystal panels 1110R and 1110B.

In this projector, because light rays with three primary colors R, G, and B separated by the dichroic mirrors 1108 are incident on the liquid crystal panels 1110R, 1110B, and 1110G, respectively, it is not required to dispose a color filter on the opposite substrate of any liquid crystal panel.

2. Portable Computer

Figure 18:
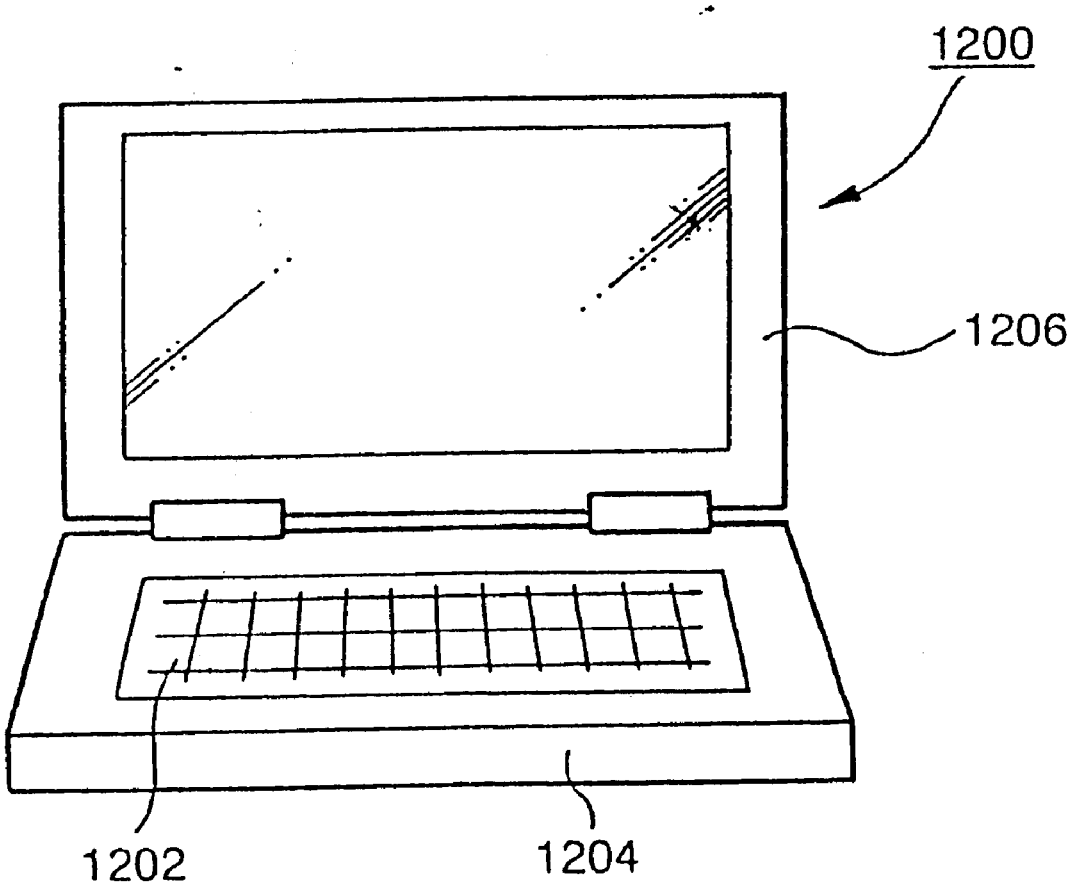
FIG. 18 is a front view illustrating a personal computer as another example of an electronic apparatus using a liquid crystal display device according to the present invention.
Figure 19:
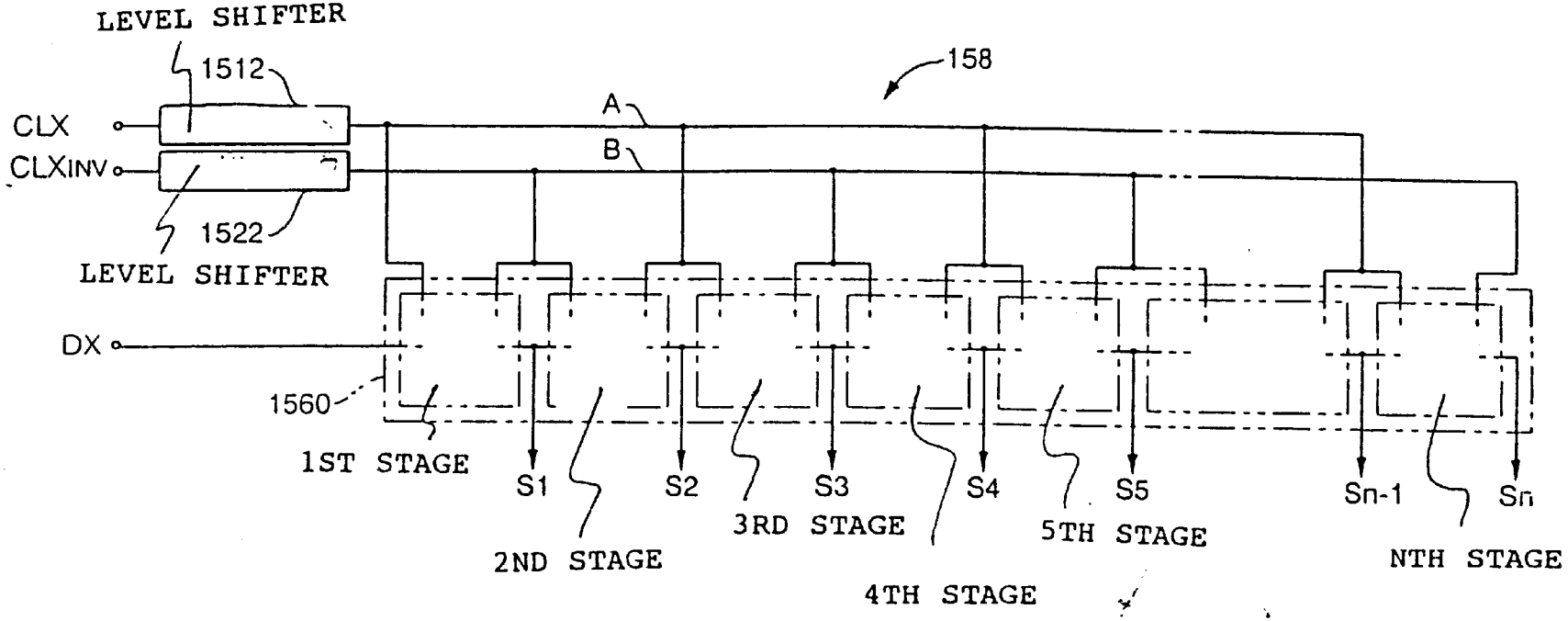
FIG. 19 PRIOR ART
FIG. 19 is a block diagram illustrating a data line driving circuit which is one of driving circuits according to a conventional technique.

As a second example of an application of the liquid crystal display panel, a portable computer is described below. FIG. 18 is a front view of the portable computer. As shown in FIG. 18, the computer 1200 comprises a main part 1204 including a key board 1202, and a liquid crystal display 1206. The liquid crystal display 1206 is formed by disposing a backlight on the back of the liquid crystal display panel 100 described above.

In addition to the electronic devices described above with reference to FIGS. 17 and 18, examples of electronic devices, to which the invention may be applied, include a liquid crystal television set, a video tape recorder with a viewfinder or a direct-view-type monitor, a car navigation device, a pager, an electronic notepad, an electronic calculator, a word processor, a work station, a portable telephone, a video telephone, a POS terminal, and an apparatus with a touch panel.

Although in the above embodiments, the invention is applied to the TFT active-matrix liquid crystal display device, the invention may also be applied to other types of liquid crystal display devices such as a STN liquid crystal display device, a passive liquid crystal display device, etc. Furthermore, the invention is not limited only to the liquid crystal display device, but the invention may also be applied to other display devices based on various electrooptical effects such as an EL device.

Furthermore, in the embodiments described above, the shift register circuit (transfer circuit) is formed of a plurality of unit circuits connected in the cascaded fashion. Herein, the unit circuits at the respective stages are not necessarily required to have the same circuit configuration. The unit circuit at a particular stage may be formed into a modified configuration, or the unit circuits may be different in configuration from stage to stage, as long as the overall circuit can operate as a shift register circuit. Furthermore, the number of stages of the shift register circuit coupled with the respective level shifters is not necessarily required to be fixed to a particular value. Instead, a particular shift register circuit may be coupled with stages whose number is different from the number of stages coupled with another shift register circuit.

As described above, the present invention provides great advantages. That is, in the present invention, level shifters are provided such that each level shifter is coupled with one or more stages of transfer circuit, and the clock signal level-shifted into the large logic swing is supplied from each level shifter to the corresponding one or more stages of the transfer circuit. This allows a reduction in the length of lines used to supply the clock signal with the large amplitude compared with the conventional technique in which the clock signal with the large amplitude is supplied by one level shifting circuit to all stages. This results in a reduction in the capacitance associated with the large-amplitude lines and thus electric power consumed by the capacitance can be reduced.

What is claimed is:

1. A driving circuit that includes a plurality of stages connected in cascade, each of the plurality of stages transferring an input signal serving to supply a sampling pulse used to sample image data for an electro-optical element between stages preceding and succeeding thereto in response to a first clock signal deriving from a second clock signal having an amplitude smaller than that of the first clock signal, the driving circuit comprising:

a plurality of level shifters each disposed corresponding to one stage of the plurality of stages and outputting the first clock signal to the one stage, the one stage supplying the sampling pulse in response to the first clock signal outputted by the corresponding level shifter and the input signal transferred by the preceding stage.

2. The driving circuit according to claim 1, the respective stages of the driving circuit being formed such that the input signal may be transferred in different directions.

3. The driving circuit according to claim 1, further comprising:

an enabling circuit that enables the level shifters to operate immediately before, or at the same time, as the one or more stages of the driving circuit coupled with the level shifters, start transferring the input signal, and the enabling circuit also disabling the level shifters to operate immediately after, or at the same time, as the one or more stages of the driving circuit coupled with the level shifters, stops the transferring of the input signal.

4. The driving circuit according to claim 2, further comprising:

an enabling circuit that enables the level shifters to operate immediately before, or at the same time, as the one or more stages of the driving circuit coupled with the level shifters, start transferring the input signal, and the enabling circuit also disabling the level shifters to operate immediately after, or at the same time, as the one or more stages of the driving circuit coupled with the level shifters, stops the transferring of the input signal.

5. The driving circuit according to claim 3, the enabling circuit being a latch circuit which latches a first signal in response to a clock signal with a large amplitude supplied to a stage located ahead of the one or more stages of the driving circuit coupled with the level shifters, the latch circuit also latching a second signal in response to a clock signal with a large amplitude supplied to a stage located behind the one or more stages of the driving circuit coupled with the level shifters, thereby enabling and disabling the level shifters using the latched signals.

6. The driving circuit according to claim 3, the level shifters including a shutting-off circuit that shuts off the clock signal with the small amplitude applied to the level shifters when the level shifters are disabled by the enabling circuit.

7. The driving circuit according to claim 1, the driving circuit and the level shifters being formed on the same single substrate.

8. The driving circuit according to claim 7, the driving circuit and the level shifters being formed of thin film transistors formed on the same single substrate using the same process.

9. A driving circuit as set forth in claim 1, wherein each level shifter is shut off a power supply when not operating.

10. A driving circuit as set forth in claim 9, wherein each level shifter includes a shutting-off circuit that shuts off the power supply to the level shifting circuit upon judging the level shifter need not operate.

11. A driving circuit that drives an electrooptical device, comprising:

a transfer circuit that includes a plurality of stages connected in a cascaded fashion, that sequentially transfers an input signal in response to a clock signal with a large amplitude; and a plurality of level shifting circuits each disposed corresponding to one stage of the plurality of stages of the transfer circuit, each level shifting circuit serving to convert a clock signal with a small amplitude to a clock signal with a large amplitude and supply the resultant clock signal to the one stage.

12. A driving circuit that drives an electrooptical device including pixels disposed at locations corresponding to respective intersections between a plurality of scanning lines and a plurality of data lines, the driving circuit comprising:

a scanning line driving circuit that sequentially selects the scanning lines;

a data line driving circuit that includes the transfer circuit, the transfer circuit including a plurality of stages connected in a cascaded fashion for transferring an input signal in response to a clock signal with a large amplitude, the data line driving circuit serving to sequentially select the data lines on a line-by-line or group-by-group basis in response to the transferring of the input signal performed by the transfer circuit, each the group including a plurality of data lines;

a plurality of level shifting circuits each disposed corresponding to one stage of the plurality of stages of the transfer circuit, each level shifting circuit serving to convert a clock signal with a small amplitude to a clock signal with a large amplitude and supply the resultant clock signal to the onestage; and an image signal supplying circuit that supplies an image signal to one or more data lines selected by the data line driving circuit.

13. The driving circuit that drives an electrooptical device, according to claim 12, the scanning line driving circuit further comprising:

a transfer circuit that includes a plurality of stages connected in a cascaded fashion that sequentially transfers an input signal and sequentially selects the respective scanning lines in response to the transferring of the input signal; and a plurality of level shifting circuits each disposed corresponding to one stage of the plurality of stages of the transfer circuit, each level shifting circuit serving to convert a clock signal with a small amplitude to a clock signal with a large amplitude and supply the resultant clock signal to the one stage.

14. The driving circuit that drives an electrooptical device, according to claim 12, further comprising:

an enabling circuit coupled with the corresponding level shifting circuit of the data line driving circuit and/or of the scanning line driving circuit, that enables the corresponding level shifting circuit to operate, the enabling circuit enabling the level shifting circuit to operate immediately before, or at the same time, as the one stage of the transfer circuit coupled with the level shifting circuit, start transferring the input signal, the enabling circuit also disabling the level shifting circuit to operate immediately after, or at the same time, as the one stage of the transfer circuit coupled with the level shifting circuit, complete the transferring of the input signal.

15. The driving circuit that drives an electrooptical device, according to claim 13, further comprising:

an enabling circuit coupled with the corresponding level shifting circuit of the data line driving circuit and/or of the scanning line driving circuit, that enables the corresponding level shifting circuit to operate, the enabling circuit enabling the level shifting circuit to operate immediately before, or at the same time, as the one stage of the transfer circuit coupled with the level shifting circuit, start transferring the input signal, the enabling circuit also disabling the level shifting circuit to operate immediately after, or at the same time, as the one stage of the transfer circuit coupled with the level shifting circuit, complete the transferring of the input signal.

16. An electrooptical device, comprising:

pixels disposed at locations corresponding to respective intersections between a plurality of scanning lines and a plurality of data lines;

a scanning line driving circuit that sequentially selects the scanning lines;

a data line driving circuit that includes a transfer circuit, the transfer circuit including a plurality of stages connected in a cascaded fashion that transfer an input signal in response to a clock signal with a large amplitude, the data line driving circuit serving to sequentially select the data lines on a line-by-line or group-by-group basis in response to the transferring of the input signal performed by the transfer circuit, each the group including a plurality of data lines;

a plurality of level shifting circuits each disposed corresponding to one stage of the plurality of stages of the transfer circuit, each level shifting circuit serving to convert a clock signal with a small amplitude to a clock signal with a large amplitude and supply the resultant clock signal to the one stage; and an image signal supplying circuit that supplies an image signal to one or more data lines selected by the data line driving circuit.

17. The electrooptical device according to claim 16, the scanning line driving circuit further comprising:

a transfer circuit that includes a plurality of stages connected in a cascaded fashion that sequentially transfer an input signal and sequentially select the respective scanning lines in response to the transferring of the input signal; and a plurality of level shifting circuits each disposed corresponding to one stage of the plurality of stages of the transfer circuit, each level shifting circuit serving to convert a clock signal with a small amplitude to a clock signal with a large amplitude and supply the resultant clock signal to the stage.

18. The electrooptical device according to claim 16, further comprising:

an enabling circuit coupled with the corresponding level shifting circuit of the data line driving circuit and/or of the scanning line driving circuit, that enables the corresponding level shifting circuit to operate, the enabling circuit enabling the level shifting circuit to operate immediately before, or at the same time, as the one stage of the transfer circuit coupled with the level shifting circuit, start transferring the input signal, the enabling circuit also disabling the level shifting circuit to operate immediately after, or at the same time, as the one stage of the transfer circuit coupled with the level shifting circuit, complete the transferring of the input signal.

19. The electrooptical device according to claim 17, further comprising:

an enabling circuit coupled with the corresponding level shifting circuit of the data line driving circuit and/or of the scanning line driving circuit, that enables the corresponding level shifting circuit to operate, the enabling circuit enabling the level shifting circuit to operate immediately before, or at the same time, as the one stage of the transfer circuit coupled with the level shifting circuit, start transferring the input signal, the enabling circuit also disabling the level shifting circuit to operate immediately after, or at the same time, as the one stage of the transfer circuit coupled with the level shifting circuit, complete the transferring of the input signal.

20. The electrooptical device according to claims 16, further comprising:

a liquid crystal disposed between two substrates;

transistors corresponding to respective pixels, the transistors serving to apply the image signal supplied to the data lines to the corresponding pixels, the transistors being formed on one of the two substrates, the transfer circuit and the level shifting circuit of the data line driving circuit and/or of the scanning line driving circuit being formed of thin film transistors formed on the one of the two substrates using the same process.

21. The electrooptical device according to claims 17, further comprising:

a liquid crystal disposed between two substrates;

transistors corresponding to respective pixels, the transistors serving to apply the image signal supplied to the data lines to the corresponding pixels, the transistors being formed on one of the two substrates, the transfer circuit and the level shifting circuit of the data line driving circuit and/or of the scanning line driving circuit being formed of thin film transistors formed on the one of the two substrates using the same process.

22. The electrooptical device according to claims 18, further comprising:

a liquid crystal disposed between two substrates;

transistors corresponding to respective pixels, the transistors serving to apply the image signal supplied to the data lines to the corresponding pixels, the transistors being formed on one of the two substrates, the transfer circuit and the level shifting circuit of the data line driving circuit and/or of the scanning line driving circuit being formed of thin film transistors formed on the one of the two substrates using the same process.

23. The electronic apparatus using as a display device, the electrooptical device according to claim 16.

24. A driving circuit that includes a plurality of stages connected in cascade each transferring an input signal serving to supply a sampling pulse used to sample image data for an electro-optical element between stages preceding and succeeding thereto in response to a first clock signal deriving from a second clock signal having an amplitude smaller than that of the first clock signal, the driving circuit comprising:

a plurality of level shifters each disposed corresponding to a predetermined number of stages among the plurality of stages, the predetermined number of stages being connected in a cascaded-in-series fashion, each stage corresponding to a combination of a plurality of the level shifters among the plurality of level shifters at least one of the plurality of stages corresponding to a different combination of the level shifters than another stage, and outputting the first clock signal to the predetermined number of stages, each of the predetermined number of stages supplying the sampling pulse in response to the first clock signal outputted by the corresponding level shifter and the input signal transferred by the preceding stage.

25. A driving circuit as set forth in claim 24, wherein each level shifter is shut off a power supply when not operating.

26. A driving circuit as set forth in claim 25, wherein each level shifter includes a shutting-off circuit that shuts off the power supply to the level shifting circuit upon judging the level shifter need not operate.

27. A driving circuit that includes a plurality of stages connected in cascade each transferring an input signal serving to supply a sampling pulse used to sample image data for an electro-optical element between stages preceding and succeeding thereto in response to a first clock signal deriving from a second clock signal having an amplitude smaller than that of the first clock signal, the driving circuit comprising:

a plurality of level shifters that each correspond to at least one stage of the plurality of stages, output the first clock signal to the one stage, the one stage supplying the sampling pulse in response to the first clock signal outputted by the corresponding level shifter and the input signal transferred by the preceding stage, and each level shifter includes a shutting-off circuit that shuts off the power supply to the level shifting circuit upon judging the level shifter need not operate.

28. A driving circuit that includes a plurality of stages connected in cascade each transferring an input signal serving to supply a sampling pulse used to sample image data for an electro-optical element between stages preceding and succeeding thereto in response to a first clock signal deriving from a second clock signal having an amplitude smaller than that of the first clock signal, the driving circuit comprising:

a plurality of level shifters each disposed corresponding to a predetermined number of stages among the plurality of stages, the predetermined number of stages being connected in a cascaded-in-series fashion, each level shifter corresponding to a combination of a plurality of the stages among the plurality of stages at least one of the plurality of level shifters corresponding to a different combination of the stages than another level shifter, and outputting the first clock signal to the predetermined number of stages, and outputting the first clock signal to the predetermined number of stages, each of the predetermined number of stages supplying the sampling pulse in response to the first clock signal outputted by the corresponding level shifter and the input signal transferred by the preceding stage.

29. A shift register circuit, comprising:

a plurality of stages connected in a cascaded fashion that sequentially transfer an input signal in response to a clock signal with a large amplitude;

a plurality of level shifting circuits each coupled with one or more stages of the shift register circuit, each level shifting circuit serving to convert a clock signal with a small amplitude to a clock signal with a large amplitude and supply the resultant clock signal to the one or more stages coupled with the each level shifting circuit; and an enabling circuit that enables the level shifting circuits to operate immediately before, or at the same time, as the one or more stages of the shift register circuit coupled with the level shifting circuit, start transferring the input signal, and the enabling circuit also disabling the level shifting circuits to operate immediately after, or at the same time, as the one or more stages of the shift register circuit coupled with the level shifting circuit, stops the transferring of the input signal, the enabling circuit being a logic circuit which determines the logical OR of the output signal of a stage located ahead of the one or more stages coupled with the level shifting circuit, the output signal of the one or more stages coupled with the level shifting circuit, and the output signal of a stage located behind the one or more stages coupled with the level shifting circuit, thereby enabling or disabling the level shifting circuit to operate in accordance with the output signal of the logic circuit.

30. A shift register circuit, comprising:

a plurality of stages connected in a cascaded fashion that sequentially transfer an input signal in response to a clock signal with a large amplitude;

a plurality of level shifting circuits each coupled with one or more stages of the shift register circuit, each level shifting circuit serving to convert a clock signal with a small amplitude to a clock signal with a large amplitude and supply the resultant clock signal to the one or more stages coupled with the each level shifting circuit; and an enabling circuit that enables the level shifting circuits to operate immediately before, or at the same time, as the one or more stages of the shift register circuit coupled with the level shifting circuit, start transferring the input signal, and the enabling circuit also disabling the level shifting circuits to operate immediately after, or at the same time, as the one or more stages of the shift register circuit coupled with the level shifting circuit, stops the transferring of the input signal, the level shifting circuit including a shutting-off circuit that shuts off a power supply to the level shifting circuit when the level shifting circuit is disabled by the enabling circuit.

* * * * *